US006672263B2

(12) United States Patent
Vallejos

(10) Patent No.: US 6,672,263 B2
(45) Date of Patent: Jan. 6, 2004

(54) RECIPROCATING AND ROTARY INTERNAL COMBUSTION ENGINE, COMPRESSOR AND PUMP

(75) Inventor: Tony Vallejos, 11,118 N. Mayfair St., Spokane, WA (US) 99218

(73) Assignee: Tony Vallejos, Spokane, WA (US)

( * ) Notice: Subject to any disclaimer, the term of this patent is extended or adjusted under 35 U.S.C. 154(b) by 0 days.

(21) Appl. No.: 10/094,578

(22) Filed: Mar. 6, 2002

(65) Prior Publication Data

US 2003/0168026 A1 Sep. 11, 2003

(51) Int. Cl.[7] ..... F02B 57/00

(52) U.S. Cl. ..... 123/43 A; 123/63; 123/197.1; 123/197.3; 74/50; 74/52

(58) Field of Search ..... 123/43 A, 43 AA, 123/63, 197.1, 197.4, 197.2, 197.3; 475/198; 74/50, 53; 91/499, 500, 502; 417/271, 392

(56) References Cited

U.S. PATENT DOCUMENTS

| | | | | | |
|---|---|---|---|---|---|
| 1,255,664 | A | * | 2/1918 | Syger | 123/43 A |
| 1,281,981 | A | * | 10/1918 | Krienitz | 123/63 |
| 1,405,224 | A | | 1/1922 | Kenmonth | 12/43 A |
| 1,569,525 | A | | 1/1926 | Owens | 123/43 A |
| 1,571,465 | A | | 2/1926 | Bair | 123/43 A |
| 1,614,476 | A | | 1/1927 | Hutchinson | 123/43 A |
| 1,698,598 | A | * | 1/1929 | Kussner | 123/197.1 |
| 1,857,000 | A | | 5/1932 | Kleschka | 123/43 A |
| 1,878,767 | A | * | 9/1932 | Freund | 123/43 A |
| 2,254,817 | A | * | 9/1941 | Blenker | 123/63 |
| 2,683,422 | A | | 7/1954 | Richards, Jr. | 123/44 R |
| 2,949,100 | A | | 8/1960 | Petersen | |
| 3,807,370 | A | | 4/1974 | Baugh | |
| 3,886,805 | A | * | 6/1975 | Koderman | 74/52 |
| 3,968,777 | A | | 7/1976 | Franke | |
| 3,990,423 | A | | 11/1976 | Cross et al. | |
| 4,022,167 | A | | 5/1977 | Kristiansen | 123/43 AA |
| 4,078,439 | A | * | 3/1978 | Iturriaga-Notario | 123/197.1 |
| RE30,565 | E | | 4/1981 | Kristiansen | 123/43 AA |
| 4,287,858 | A | | 9/1981 | Anzalone | 123/43 AA |
| 4,752,192 | A | * | 6/1988 | Ode | 417/271 |
| 5,103,778 | A | | 4/1992 | Usich, Jr. | 123/43 AA |
| 5,209,190 | A | | 5/1993 | Paul | 123/43 AA |
| 5,316,451 | A | * | 5/1994 | Hore et al. | 417/392 |
| 5,347,960 | A | * | 9/1994 | Tokumi | 123/63 |
| 5,351,566 | A | * | 10/1994 | Barnett | 74/50 |
| 5,673,665 | A | * | 10/1997 | Kim | 123/197.1 |
| 5,785,029 | A | * | 7/1998 | Fischer | 123/197.3 |
| 5,813,372 | A | | 9/1998 | Manthey | 123/43 A |
| 5,878,707 | A | | 3/1999 | Ballard | |
| 5,931,134 | A | | 8/1999 | Kudryashov | |
| 5,967,108 | A | | 10/1999 | Kutlucinar | |
| 5,970,934 | A | | 10/1999 | Vallejos | |
| 5,992,397 | A | | 11/1999 | Hideaki et al. | |
| 6,024,067 | A | * | 2/2000 | Takachi et al. | 123/197.1 |
| 6,186,098 | B1 | * | 2/2001 | Choi | 74/50 |
| 6,223,703 | B1 | | 5/2001 | Galvin | |
| 6,257,191 | B1 | | 7/2001 | Kutlucinar | |
| 2001/0029922 | A1 | * | 10/2001 | Dow | 123/197.1 |

FOREIGN PATENT DOCUMENTS

| | | | | |
|---|---|---|---|---|
| EP | 164317 A1 | * | 12/1985 | F02B/75/32 |
| FR | 416890 | * | 10/1910 | 123/43 A |
| GB | 1084 | * | of 1913 | 123/43 A |
| JP | 55078101 A | * | 6/1980 | F01B/9/04 |

* cited by examiner

*Primary Examiner*—Thomas Denion
*Assistant Examiner*—Thai-Ba Trieu
(74) *Attorney, Agent, or Firm*—Wells St. John P.S.

(57) ABSTRACT

A rotary engine, pump or compressor with a intake/exhaust ports in end plates and a rotatably mounted block mounted in a framework. In an embodiment cylinder sets are mounted in the block and each includes opposing cylinders with ends which include transfer ports disposed to alternately form passageways with the intake and exhaust ports as the cylinders rotate with the block. A novel crankset operatively connects the block to the driveshaft.

31 Claims, 20 Drawing Sheets

RECIPROCATING AND ROTARY INTERNAL COMBUSTION ENGINE, COMPRESSOR AND PUMP

CROSS REFERENCE TO RELATED APPLICATION

There are no related applications.

TECHNICAL FIELD

This invention generally pertains to an internal combustion engine, pump and/or compressor for use in numerous applications, including motor vehicles. More particularly, this invention pertains to such an engine, pump and/or compressor which includes rotary movement as well as reciprocating pistons.

BACKGROUND OF THE INVENTION

For many years the predominant type of engine, pump or compressor has been the reciprocating type. While benefits may be achieved with a rotary engine, pump or compressor, problems have been incurred with specific applications of rotary concepts previously attempted.

It will be appreciated by those of ordinary skill in the art that this invention has applications and embodiments not only for engines but also for pumps and compressors, even though an engine will be referred to and used throughout this specification.

It is therefore an object of this invention to provide an improved engine, pump or compressor with reciprocating pistons and rotary movement.

BRIEF DESCRIPTION OF THE DRAWINGS

Preferred embodiments of the invention are described below with reference to the following accompanying drawings:

FIG. 6 illustrates a first possible cylinder position at 0 degrees;

FIG. 7 illustrates a second cylinder position at approximately 45 degrees from that shown in FIG. 6;

FIG. 8 illustrates a cylinder configuration at 120 degrees from that shown in FIG. 6;

FIG. 9 illustrates a cylinder configuration at 180 degrees from that shown in FIG. 6;

FIG. 10 illustrates a cylinder configuration at 240 degrees from that shown in FIG. 6; and FIG. 11 illustrates a cylinder configuration at 300 degrees from that shown in FIG. 6;

FIG. 13 is a top schematic view of a cylinder set which may be utilized in an embodiment of this invention, showing examples of alternative positions of components of the crankset of an embodiment of this invention;

FIG. 30 illustrates an example of an arbitrary starting point of the piston set and crank set, within the cylinder set, as may be utilized in one embodiment of the invention;

FIG. 31 illustrates the piston set and crank set within the cylinder set, rotated ninety degrees from that shown in FIG. 30;

FIG. 32 illustrates the piston set and crank set within the cylinder set, rotated one hundred eighty degrees from that shown in FIG. 30;

FIG. 33 illustrates the piston set and crank set within the cylinder set, rotated two hundred seventy degrees from that shown in FIG. 30;

FIG. 34 illustrates the piston set and crank set within the cylinder set, rotated three hundred fifteen degrees from that shown in FIG. 30;

FIG. 35 illustrates the piston set and crank set within the cylinder set, rotated three hundred sixty degrees from that shown in FIG. 30;

FIG. 36 is a perspective view of an embodiment of the invention without the outer housing;

FIG. 38 is a cross-sectional view of another embodiment of an engine contemplated by this invention, in which the rotation of the engine is via external gearing as shown; and FIG. 39 is a cross-sectional view of another embodiment of an engine contemplated by this invention, in which the rotation of the engine is via external gearing as shown.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
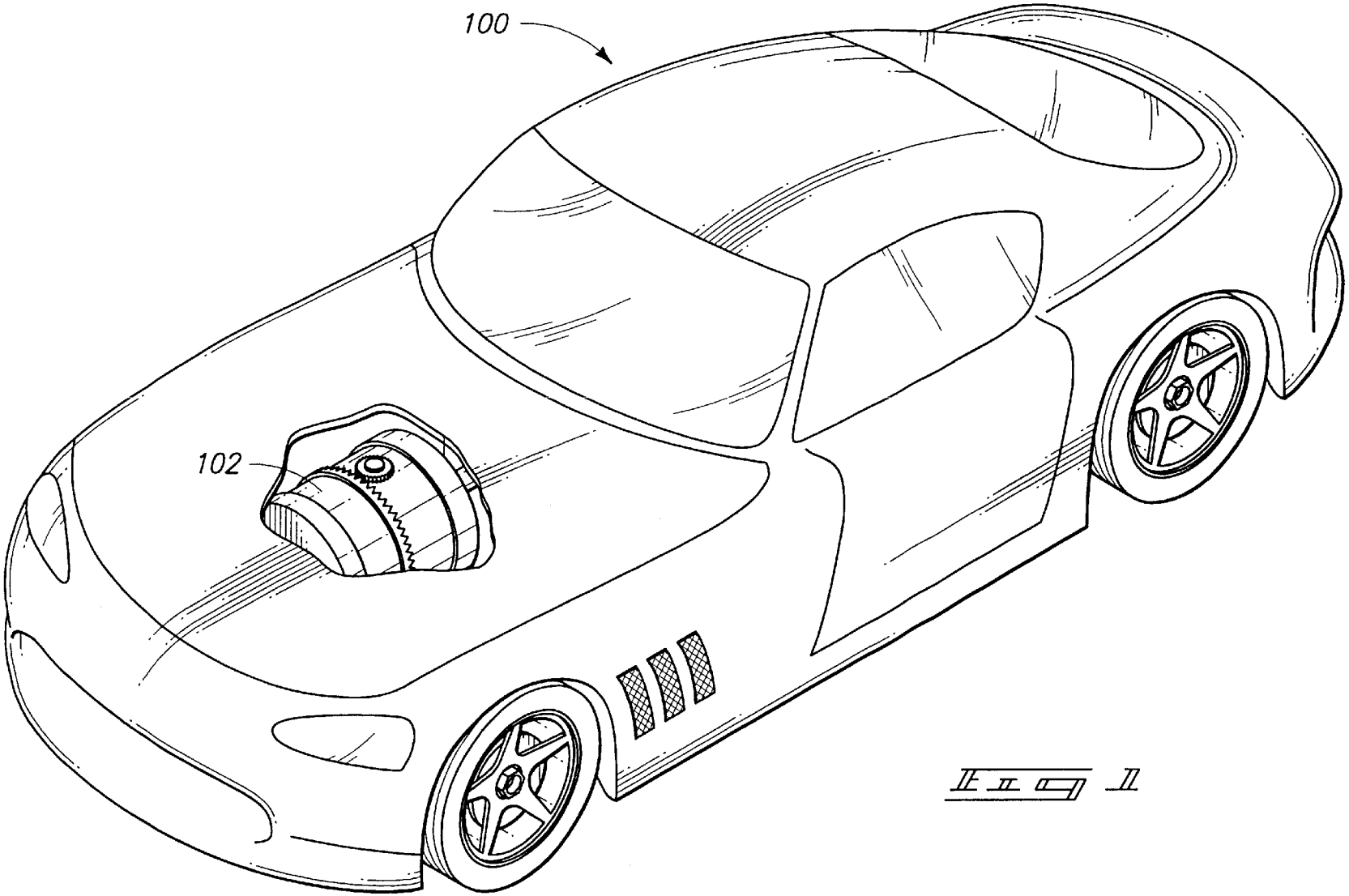
FIG. 1 is a perspective view of a vehicle, illustrating a housing for an embodiment of the invention within said vehicle.

FIG. 1 shows a vehicle 100 with an internal combustion rotary and reciprocating engine 102 within the vehicle. Again although the term engine is used throughout as the embodiment illustrated, this invention applies equally to pumps and compressors.

Figure 2:
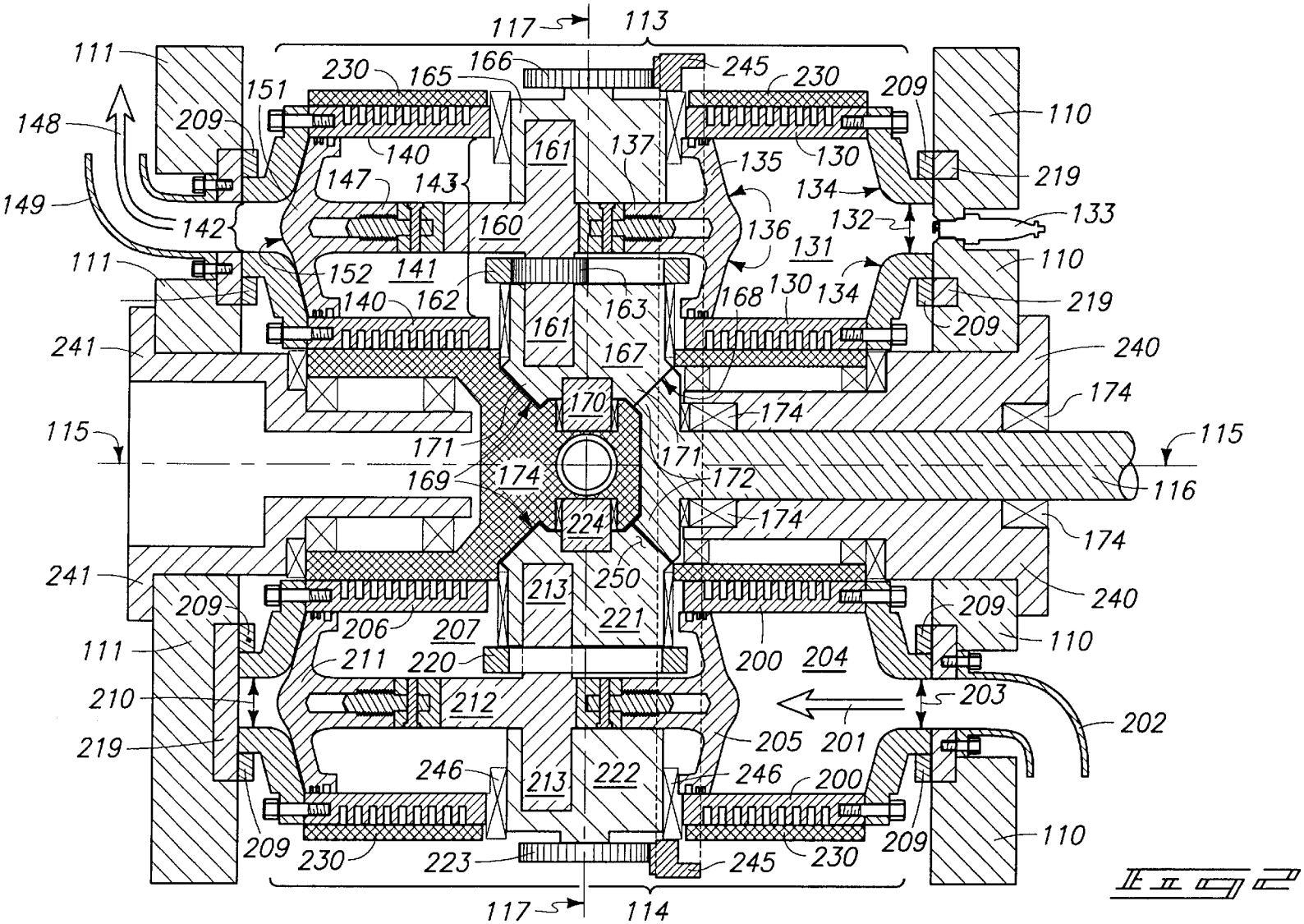
FIG. 2 is a cross-sectional view of one embodiment of an engine contemplated by this invention.

FIG. 2 is a cross-sectional view of one embodiment of four cylinders of an engine contemplated by this invention. FIG. 2 illustrates an embodiment of this invention wherein first cylinder set 113 includes a first cylinder and opposing second cylinder, each cylinder comprising a proximal end (143 for the second cylinder) open to its opposing cylinder and a terminal end having a transfer port 132 & 142, each transfer port 132 & 142 being disposed to alternately form a passageway with the intake port and exhaust port in the end plate 110 or 111.

The first cylinder set 113 and the second cylinder set 114 rotate about central axis 115 of the engine. Rear end plate 110 and front end plate 111 provide intake ports, exhaust ports and a spark plug 133 housing in the embodiment shown. The front end plate 111 and rear end plate 110 are stationary while the first cylinder set 113 and the second cylinder set 114 rotate relative to the end plates and around central axis 115.

The rotation of the cylinder sets 113 and 114 around central axis 115 is driven by the piston set, cylinder set and crank set or system illustrated in the figures.

The first cylinder set 113 includes a first cylinder 130 with an internal cavity 131, terminal end 134 with transfer port 132 being disposed to form passageways with intake and exhaust ports and spark plugs 133 in rear end plate 110.

Second cylinder 140 is in opposed relation to first cylinder 130 and FIG. 2 illustrates internal cavity 141 to second cylinder 140, proximal end 143 which may be open and transfer port 142 at the terminal end of second cylinder 140. FIG. 2 illustrates transfer port 142 aligned with an exhaust port in front end plate 111 to allow exhaust gasses 148 to exit through exhaust manifold 149.

First piston set is illustrated within first cylinder set in FIG. 2, showing first piston head 135 with piston face 136 and piston rod 137, the first end of piston rod 137 being mounted to piston head 135. Second piston is mounted within cylinder 140 and shows piston head 151 with piston face 152, and piston rod 147. A first end of piston rod 147 is mounted to piston head 151.

In the first piston set in the preferred embodiment shown, the first piston and the second piston are operatively attached or integral such that they move together during the operation of the embodiment of the engine shown.

The first cylinder set 113 and first piston set serve to drive the crank set or crank system illustrated in this embodiment. The piston set, as shown more fully in other figures, includes a circular base aperture in the piston configuration between the first piston and the second piston, the circular base aperture is disposed to receive a circular base rotatably mounted within the circular base aperture about a transverse crank set axis, shown as item 117 in FIG. 2. The circular base 160 has crankpin 161 eccentrically mounted therein or thereon. Crankpin gear 163, preferably a spur gear, is mounted in a fixed relationship to crankpin 161 such that they move together in a fixed relationship.

Internal gear 162 (or second gear) has internal teeth which are configured to mate with external gear teeth on crankpin gear 163 such that crankpin gear 163 rotates within internal gear set 162, as shown more fully in later figures.

Crankpin 161 is eccentrically mounted within first outer-crank module 165 and eccentrically mounted within first inner crank module 167. The drive or crank force from the piston set causes crankpin 161 to rotate about transverse crank axis 117, thereby forcing rotation of first outer crank module 165 and first inner crank module 167. Mounted to first outer crank module 165 is an outer crank module gear 166 which rotates with first outer crank module 165. As first outer crank module 165 and outer crank module gear 166 rotate, the external gear teeth on outer crank module gear 166 mate and interact with gear teeth on ring gear 245 (shown more fully in later figures) to cause rotation of first cylinder set 113 and second cylinder set 114 about central axis 115. Ring gear 245 is more fully shown in later figures but is stationary.

As crankpin 161 rotates, it also causes first inner crank module 167 to rotate, and first inner crank module 167 has inner crank module gears 171 thereon (which may be integral or attached thereto). First inner crank module 167 likewise is forced to rotate about crank set axis 117. Inner crank module gears 171 mate with gears 169 on drive shaft bearings 174 to also force rotation of first cylinder set 113 and second cylinder set 114 about central axis 115. Drive shaft bearings 174 rotates about central axis 115. This thereby provides two points of contact or gear interaction for first cylinder set to provide rotation about central axis 115 and similarly, there are two points of gear interaction or contact to drive second cylinder set 114 about central axis 115.

It should be noted that while inner and outer crank modules are identified, used and preferred in the embodiment of the invention illustrated, they are not necessary to practice the invention. There are other ways to eccentrically and rotatably mount the crankpin 161 relative to a point on the piston set and relative to the outer crank module gears 166 and 223, to allow for the combined motion illustrated.

Drive shaft 116 has drive shaft gear set 162 with gear teeth 168 which interact with first inner crank module 167 gear 171 to allow the crank set to cause rotation of drive shaft 116.

It will be appreciated that the two cylinders within first cylinder set 113, and the components thereof, operate similarly to the two cylinders in second cylinder set 114, all combining to drive the rotation of the cylinder sets about central axis and to drive and rotate drive shaft 116. It will further be appreciated that while the section view in FIG. 2 only shows four cylinders, this is only one embodiment, and four more cylinders may be added in similar fashion to the configuration at 90 degree offset to the existing four cylinders.

On the lower side of FIG. 2, second cylinder set 114 components are illustrated. FIG. 2 shows third cylinder 200 with internal cavity 204, transfer port 203 and intake 201 from intake manifold 202. Piston head 205, the third piston head, is similarly configured to fourth piston head 211, and both, as described relative to first cylinder set 113. Fourth cylinder 206 includes internal cavity 207 and transfer port 210.

FIG. 2 further illustrates stabilizing stub shaft 170 for first cylinder set 113 and second stabilizing stub shaft 224 for second cylinder set 114. Second cylinder set 114 interacts with the crank set shown with the following components illustrated: second inner crank module 221 with second inner crank module gears 250.

Further shown in FIG. 2 are second outer crank module 222 with second crankpin 213 eccentrically mounted therein and eccentrically mounted on circular base 212. It is preferable that crankpin 213 be integral or unitary with circular base 212, although it is not necessary to practice this invention.

FIG. 2 further illustrates second outer crank module 222 with second outer gear 223 rotating with second outer crank module 222. Similarly to first outer gear 166 mating with ring gear 245, second outer gear 223 likewise mates with gear teeth on ring gear 245 to also cause rotation of the cylinder sets about central axis 115. FIG. 2 also illustrates central block 230 about the first cylinder set 113 and the second cylinder set 114. Face plate 209 is also shown in FIG. 2 but more fully illustrated in later figures. In an embodiment of this invention the face plate 209 may be spring loaded or force biased to assist in the sealing of ports interacting with the transfer ports of the cylinders.

Figure 22:
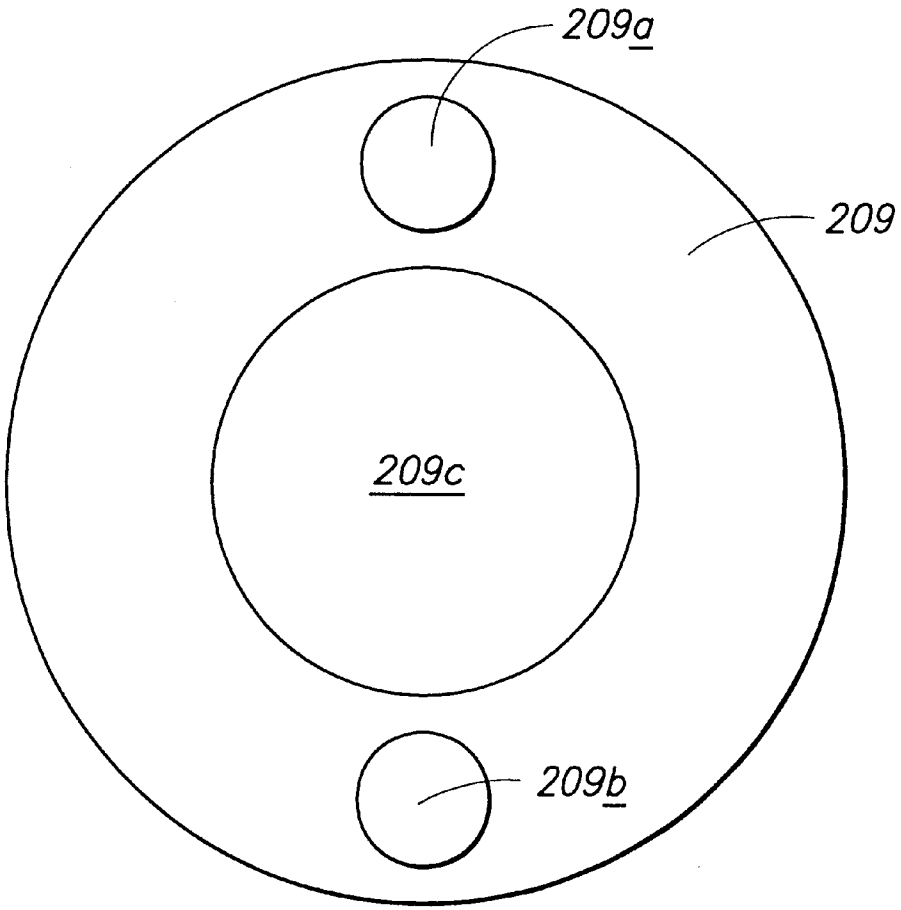
FIG. 22 is an end elevation view of a face plate which may be utilized in combination with an end plate in an embodiment of this invention.

FIG. 2 shows face plate 209 within the end plates and as shown more fully in FIG. 22, as well as port plate 219 or valve plate, which is also shown in FIGS. 4–11. While not necessary, it is preferable to use port plates 219 and face plates 209 for manufacturing and/or sealing reasons, among others. The port plates 219 may be generally configured and shaped similar to the face plates 209, only with porting apertures. Bias forces may be utilized between port and face plates and end plates to achieve the desired sealing for any particular embodiment.

In FIG. 2 it will be appreciated that driveshaft mount 240 may be fixed to the rear end plate 110 and front bearing mount 241 may be fixedly mounted to front end plate 111, with the invention not being restricted to any one particular application.

It will be appreciated by those of ordinary skill in the art that the basic components of this engine, pump or compressor may be adapted for use with diesel fuel as well as other fuel such as gasoline.

It should also be noted that in another embodiment contemplated by the invention, the framework and consequently the end plates, are stationary, and the port plates 219 rotate relative to the framework, end plates and the block 230. In this embodiment, intake and exhaust ports in the end plates would preferably be utilized in combination with the port apertures in the port plates 219 to accomplish the intake and exhaust functions of the invention. In this embodiment, it would not be necessary to rotate the block 230 and those components related to the rotation of the block 230 would not be necessary. The intake and exhaust functions accomplished as part of the valving would be accomplished by rotating other members such as the port plates 219 as explained herein, or the rotation of the framework or end plates, as described below. The rotation of the port plates 219 or of the framework or end plates (as described below) can be accomplished in any one of a number of known mechanical ways known in the art.

In yet another embodiment of the invention, the framework, which in the embodiment shown would include the end plates, along with the port plates 219 therein, could be rotated and the block maintained as stationary.

Figure 3:
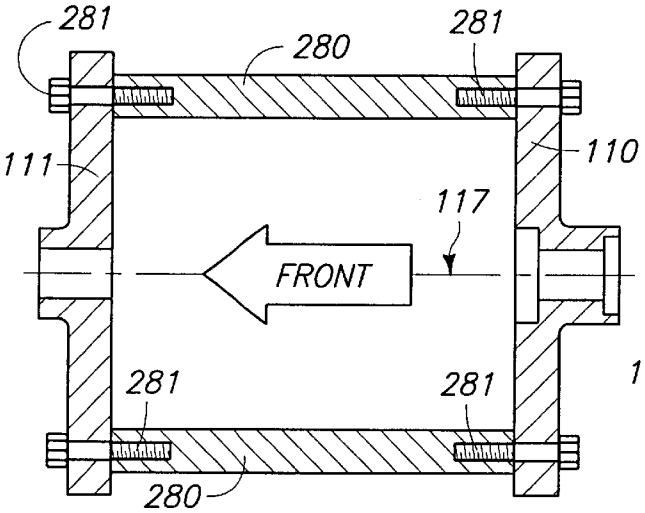
FIG. 3 is a side elevation view of end plates and the interconnection of end plates in one embodiment of this invention.

FIG. 3 is a front schematic elevation view of embodiments of a rear end plate 110 and the front end plate 111 which may be utilized in the embodiment of this invention illustrated in FIG. 2. In one embodiment, spacer dowels 280 are used to fix the relative positions of the front end plate 111 and the rear end plate 110 and bolts 281 are utilized to attach the end plates to the spacer dowels. It will be appreciated by those of ordinary skill in the art that there are other ways to space and retain the end plates within the contemplation of this invention, such as by framework supports behind the end plates or any one of a number of other ways, although the spacing dowels are preferred at this time. FIG. 3 further illustrates central axis 117 around which the cylinder sets and the drive shaft would rotate.

Figure 4:
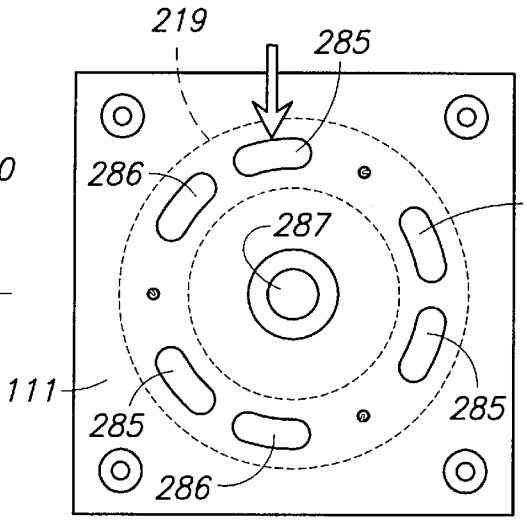
FIG. 4 is an end elevation view of a front end plate which may be utilized in an embodiment of this invention.

FIG. 4 is a first end view from the front of front end plate 111, illustrating front end plate 111, three intake ports 285 and three exhaust ports 286. FIG. 4 further illustrates front bearing mount aperture 287 configured to receive a front bearing mount transfer ports rotate about the central axis, as shown in later figures.

Figure 5:
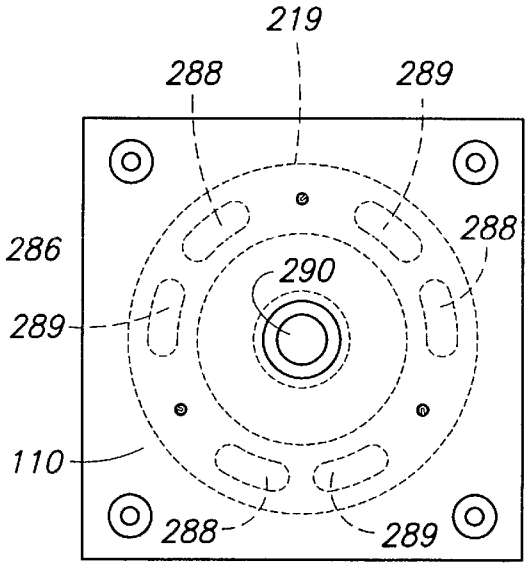
FIG. 5 is a rear end elevation view of a rear end plate which may be utilized in an embodiment of this invention.

FIG. 5 is a second end view of rear end plate 110 illustrating three intake ports 288 and three exhaust ports 289, along with drive shaft mount aperture 290. In the embodiment shown and described, the rear end plate ports are out of phase with the front end plate ports by approximately thirty (30) degrees counterclockwise, looking from the front. Arranging the rear end ports out of phase with the front end plate ports allows for cylinder firing to occur at even intervals as the double-sided piston reciprocates in its bores, creating the four cycles of intake, compression, combustion and exhaust. The combustion is initiated by the spark plug with timing similar to standard reciprocating engines which are generally known.

In looking back at FIG. 4, there may be three firing cycles per cylinder set revolution, where the cylinder set is the cylinders, the pistons and their mounting assembly. By way of example, it would take approximately six revolutions of the crank shaft to produce one revolution of a cylinder about the engine's centerline. That ratio and that one cylinder fires three times during that one revolution. Two turns of the crank set produces four combustion cycles, which may be the same as standard eight-cylinder engines.

As shown in FIGS. 4 and 5, exhaust ports and intake ports are arranged radially to communicate with the cylinder ports or transfer ports as the transfer ports are rotated about the central axis of the engine. The inlet and exhaust ports in the front end plate 111 are arranged in clockwise order with the exhaust port being first to communicate with the cylinder port in their respective groupings. In the layout shown in FIGS. 4 and 5, layouts of the end plates shown in FIGS. 4 and 5, the diagram is for an eight-cylinder version of the engine, which is contemplated by embodiments of this invention. In the embodiments in which only four cylinders are utilized, it will produce half as many combustion cycles.

The end plates shown in FIGS. 3, 4 and 5 also may function as framing members and mounting fixtures for port plates, intake and exhaust systems and as cooling towers for the engine coolant. Coolant passages may be machined or cast into the interior of the end plates surrounding all the attached entities.

FIGS. 6 through 11 show the rotation schematic end view of the rear end plate 110 as the cylinder sets rotate about the center axis of the engine, at approximately 60-degree intervals.

Figure 6:
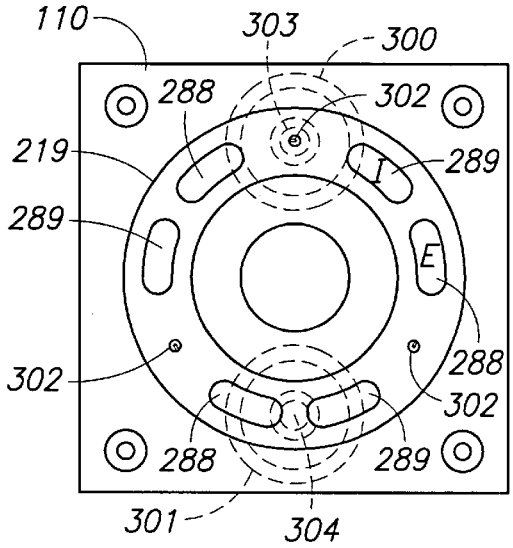
FIGS. 6–11 illustrate the movement and positioning of cylinders relative to the cylinder ports shown on the rear end plate illustrated in FIG. 5.

FIG. 6, for example, would be the theoretical starting point or 0 degrees location of the cylinder set relative to the rear end plate 110. First cylinder 300 and second cylinder 301 are shown, first cylinder 300 including first cylinder transfer port 303 and second cylinder 301 including second cylinder transfer port 304. Intake ports 289 and exhaust ports 288 are shown at approximate 60-degree angles offset from one another and spark plugs 302 are shown in their relative position.

Figure 7:
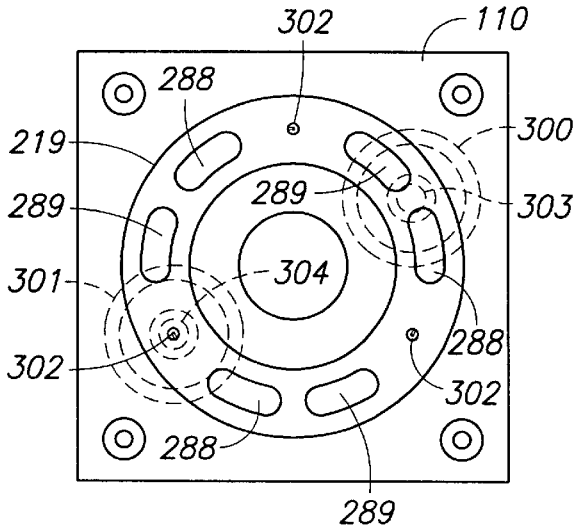

FIG. 7 is same view and item numbers as FIG. 6, only with first cylinder 300 and second cylinder 301 each rotated approximately 60 degrees relative to FIG. 6.

Figure 8:
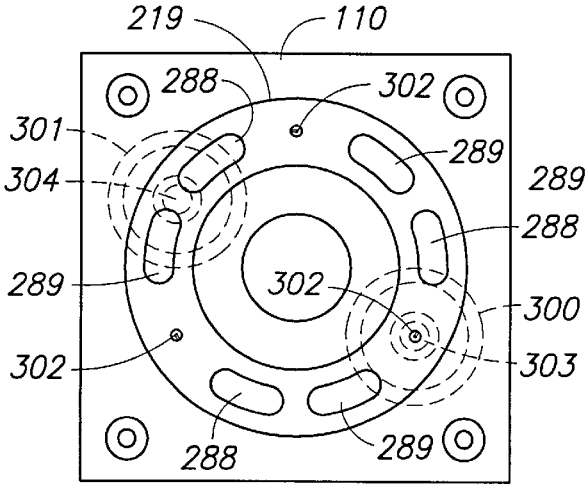

FIG. 8 is same view and item numbers as FIG. 6, only with first cylinder 300 and second cylinder 301 each rotated approximately 120 degrees relative to FIG. 6.

Figure 9:
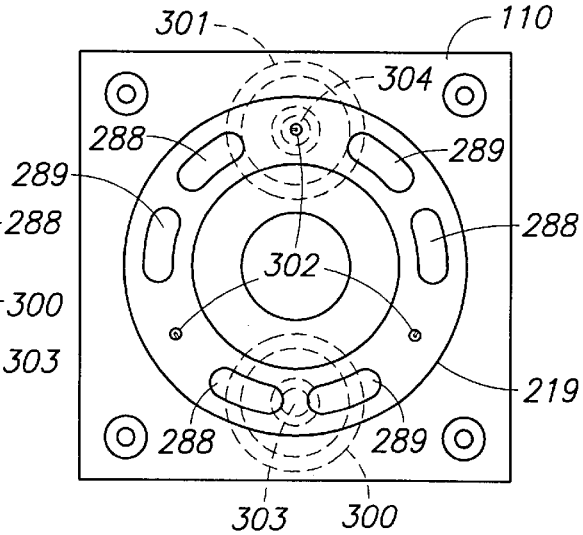

FIG. 9 is same view and item numbers as FIG. 6, only with first cylinder 300 and second cylinder 301 each rotated approximately 180 degrees relative to FIG. 6.

Figure 10:
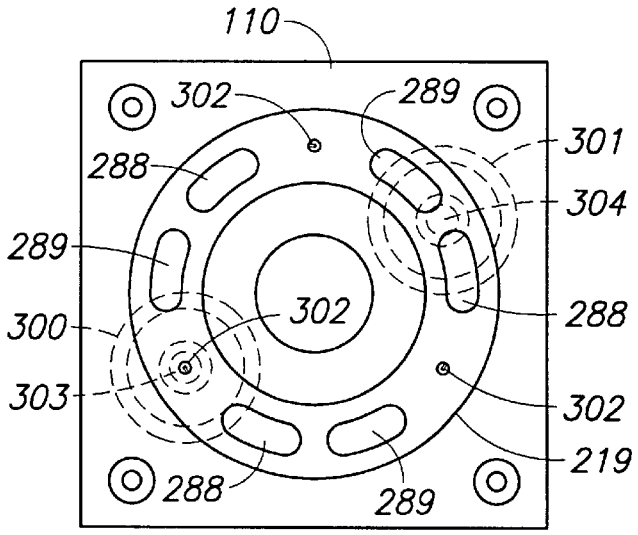

FIG. 10 is same view and item numbers as FIG. 6, only with first cylinder 300 and second cylinder 301 each rotated approximately 240 degrees relative to FIG. 6.

Figure 11:
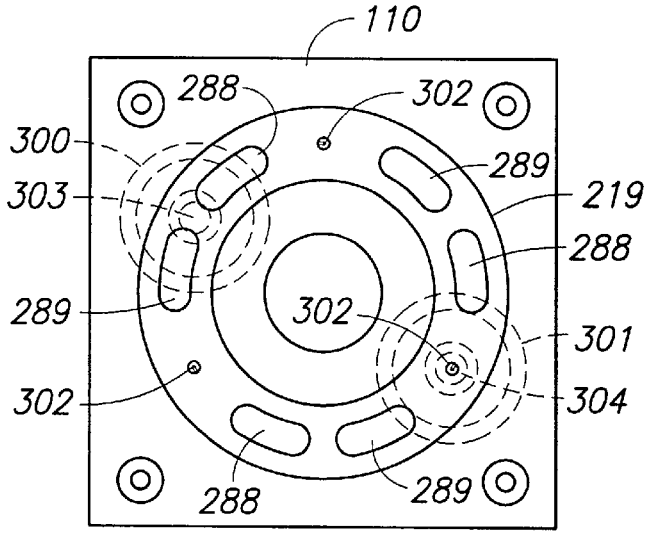

FIG. 11 is same view and item numbers as FIG. 6, only with first cylinder 300 and second cylinder 301 each rotated approximately three hundred degrees (300°) degrees relative to FIG. 6.

Figure 12:
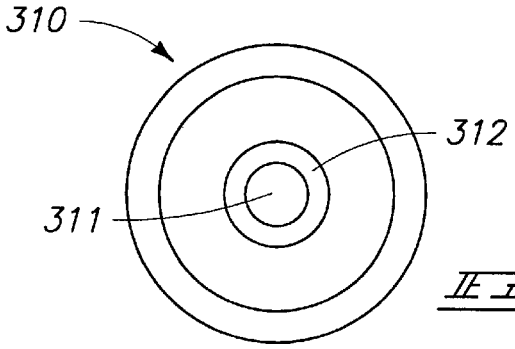
FIG. 12 is an end view of a cylinder and cylinder transfer port which may be utilized in an embodiment of this invention and as shown in relative positions in FIGS. 6 through 11.
Figure 11:
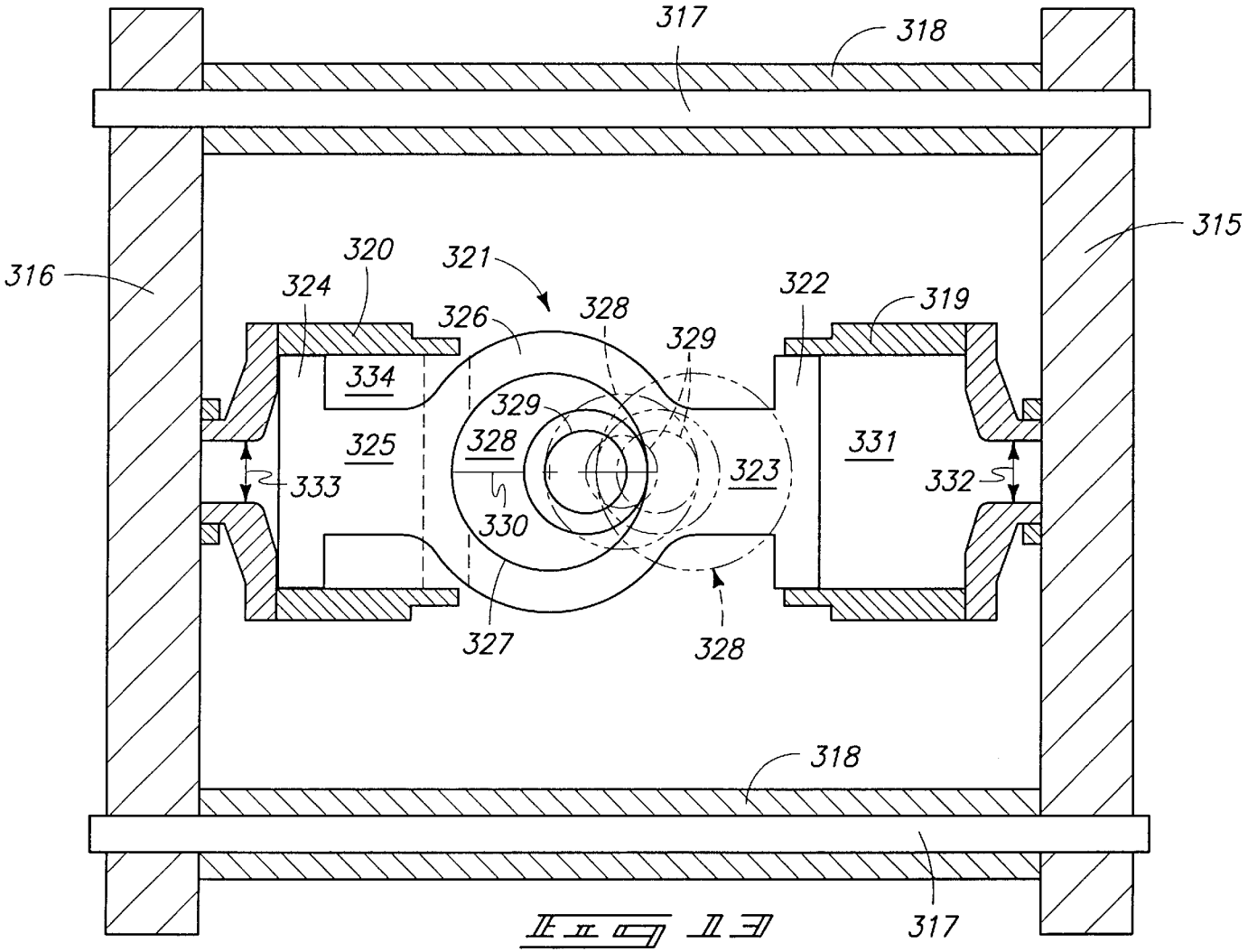
Figure 14:
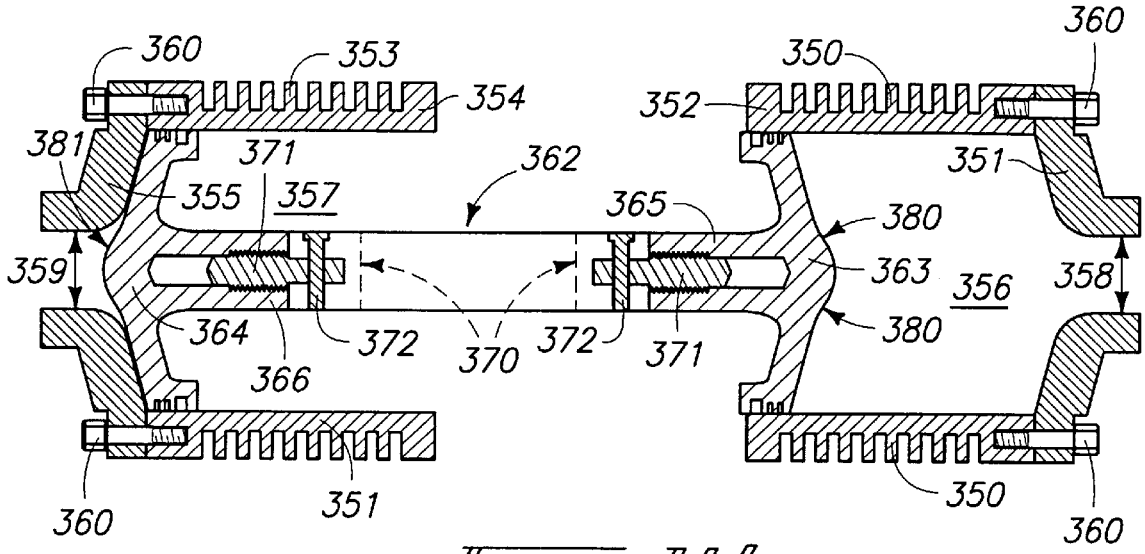
FIG. 14 is a schematic elevation representation of a piston set and cylinder set which may be utilized in an embodiment of this invention.

FIG. 12 is a simplified end view schematic of a cylinder, such as a cylinder shown in FIG. 14, illustrating an exemplary cylinder 310 with transfer port 311 and terminal end 312 which would interact with an end plate. The cylinder shown in FIG. 12 is an exemplary cylinder, simplified for purposes of illustration.

FIG. 13 illustrates the movement of piston set 321 in linear fashion such that the first piston head 322 and the second piston head 324, along with the piston rods 323 and 325 move or reciprocate in a substantially linear movement or direction. FIG. 13 illustrates rear end plate 315, front end plate 316, bolts 317, spacing dowel 318, first cylinder 319 with first cylinder internal cavity 331 or combustion chamber, second cylinder 320 with internal cavity 334. First cylinder has transfer port 332 and second cylinder transfer port 333.

As can be seen, the piston rods are integral or unitary and have the circular base aperture 327 in internal gear 326 in which circular base 328 is rotatably mounted or disposed. Crankpin 329 is eccentrically mounted on circular base 328. The sequence of phantom lines shows the relative movement of crankpin 329 through the cycle, as well as the relative movement of circular base 328, all while maintaining a substantially linear movement along axis 330 of the piston rods and piston heads.

FIG. 14 is a schematic front elevation depiction of a piston set within a cylinder set, illustrating first cylinder 350 with terminal end 351 and proximal end 352. Second cylinder 353 is shown with proximal end 354 and terminal end 355. First combustion chamber 356 and second combustion chamber 357 are also illustrated with first transfer port 358 and second transfer port 359 also being shown. Head bolts 360 are shown as one way of attaching the components of the cylinder together.

FIG. 14 also illustrates piston set 362 with first piston head 363, second piston head 364, first piston rod 365, second piston rod 366. The cylinders are illustrated with heat transfer fins on the exterior thereof.

Figure 16:
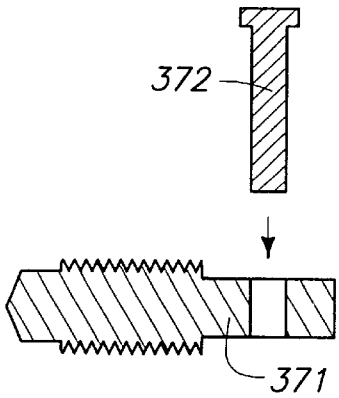
FIG. 16 is an exploded view of a piston bolt detail configuration which may be utilized in the embodiment of the invention illustrated in FIG. 15.

The piston set 362 is preferably generally integral or unitary and includes circular base aperture 370, piston bolts 371 with lock pins 372 (as shown more fully in FIG. 16).

It will be noted by those of ordinary skill in the art as shown in FIG. 14 that the first cylinder face 380 and the second cylinder face 381 are contoured to generally or substantially match the shape of terminal end 351 of cylinder 350. The matching as shown with a portion of the piston face protruding into or toward the transfer port 358 provides a more efficient configuration and better "squish" as known by those of ordinary skill in the art. While not required to practice this invention the contoured shape of the piston face and the terminal end of the cylinder are contoured and smooth, configured to efficiently allow the flow of gases and product of combustion, whereas in typical cylinders the cylinders are shaped to accommodate and/or control other aspects of the engine, such as better control of the valves.

Figure 15:
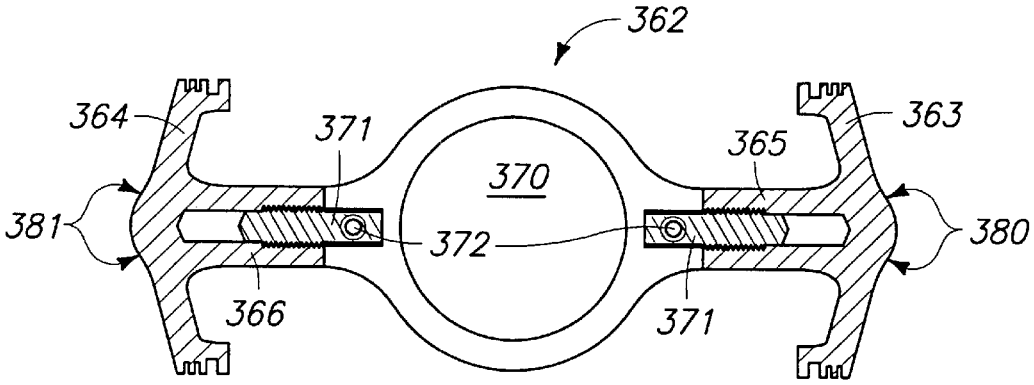
FIG. 15 is a top view of the piston configuration illustrated in FIG. 14.

FIG. 15 is a top view of the piston set 362 illustrated in FIG. 14 and shows first piston head 363, first piston face 380, first piston rod 365, piston bolt 371 and lock pin 372. FIG. 15 further shows second piston head 364 with piston face 381, piston rod 366 and circular base aperture 370.

Figure 17:
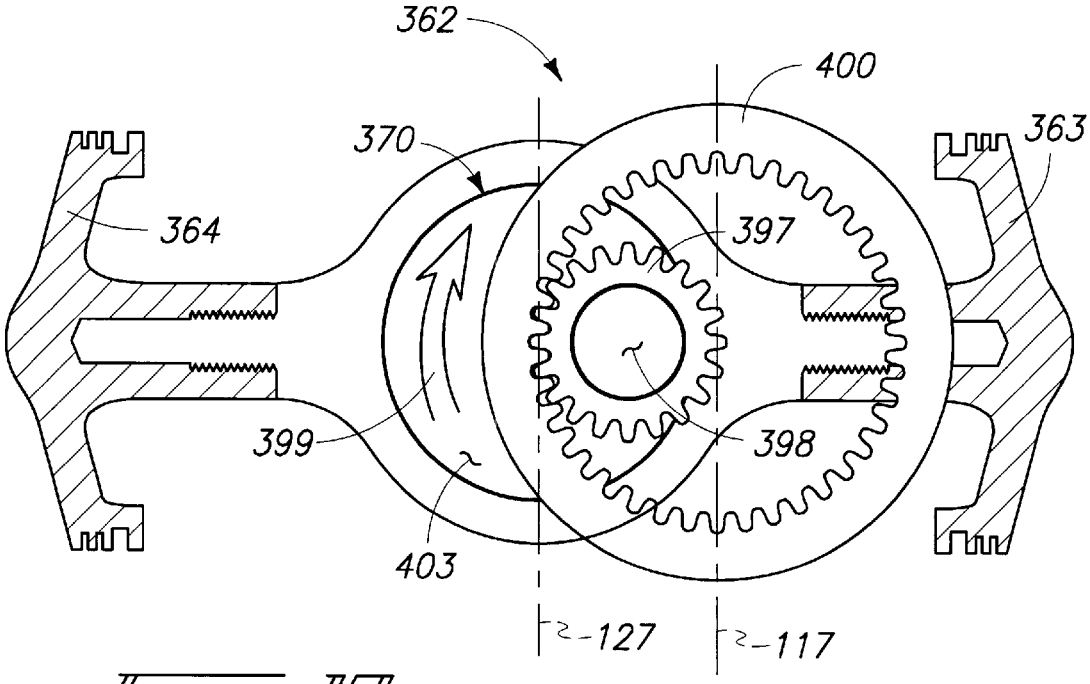
FIG. 17 is a schematic illustration of an inner crank gear configuration which may be utilized in an embodiment of this invention, showing gear detail of the crankset and the eccentrically mounted crankpin.

FIG. 17 is a top view of an embodiment of a piston set 362 contemplated by this invention, illustrating the interaction of the piston set with the internal gear 400 and crankpin gear 397, which may be a spur gear.

FIG. 17 illustrates first piston head 363, second piston head 364. Circular base aperture 370 is shown within the piston set 362 configuration with circular base 403 rotatably mounted in circular base aperture 370. Arrow 399 illustrates a direction that circular base 403 may rotate within circular base aperture 370 and crankpin axis 127 is an axis about which crankpin 398 rotates relative to the circular base 403. Crankpin 398 concurrently moves about crankset axis 117.

Crankpin 398, which may also be referred to as a main shaft, drive pin or any one of a number of different names, is preferably integral or unitary with circular base 403 and rotates therewith. Crankpin gear 401 is fixed to and around crankpin 398 and has external teeth as shown which correspond to internal teeth on internal gear 400 to matingly interact. As circular base 403 rotates clockwise in the view shown, crankpin gear 401 rotates counterclockwise within internal gear 400. The relative sizing of circular base 403, the eccentric mounting relationship of crankpin 398 to circular base 403, the size and configuration of crankpin gear 401 and the size and configuration of internal gear 400 all combine to offset one another in a transverse direction such that the overall movement of the piston set is linear, or reciprocating when it occurs within the cylinder set. The crankpin gear 401, a smaller orbiting gear, is forced around its own axis in a counterclockwise direction, thereby forcing the orbit in a clockwise direction within internal gear 400, which in turn forces the crankpin 398 and the circular base 403 to rotate clockwise. It will be appreciated by those of ordinary skill in the art that it is not necessary to utilize a circular base in a circular base aperture, but instead the crankpin 398 may otherwise be eccentrically mounted relative to the piston set to rotate about a crankpin axis and about a crankset axis.

Figure 18:
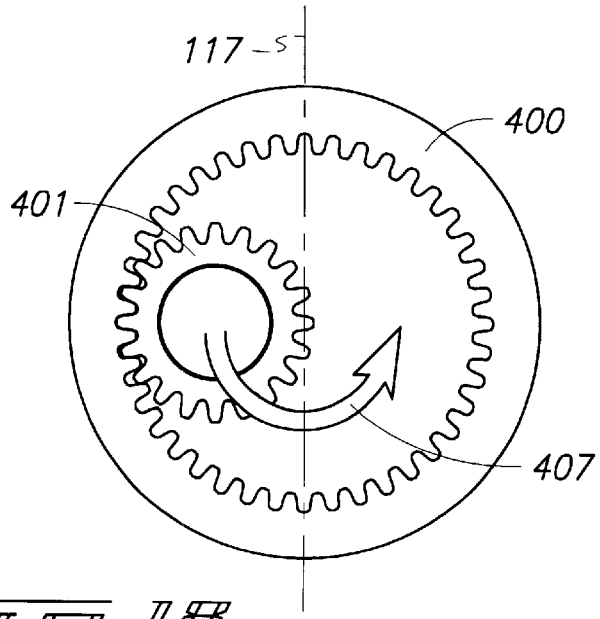
FIG. 18 is an illustration of a crankpin gear and internal gear configuration, and the rotation thereof, which may be utilized in the embodiment of the invention illustrated in FIG. 17.

FIG. 18 is an illustration of an internal gear 400, a crankpin gear 401 and a direction of rotation arrow 407 showing a counterclockwise rotation of crankpin gear 401 about its own axis, which allows the depiction of crankpin gear 401's clockwise orbit within internal gear 400. The center of internal gear 400 may also be the center of rotation of the crankset, also referred to as the crank set axis 117, which is transverse to the central axis 115 of the engine, which is shown in FIG. 2.

The internal gear 400 is preferably stationary and crankpin gear 401 generally rotates at a ratio of approximately 2 to 1 for each orbit within internal gear 400. It can also be seen that crankpin 402 is eccentrically mounted relative to the piston set, by mounting it on circular base 403 (as shown in FIGS. 17 and 18).

Figure 19:
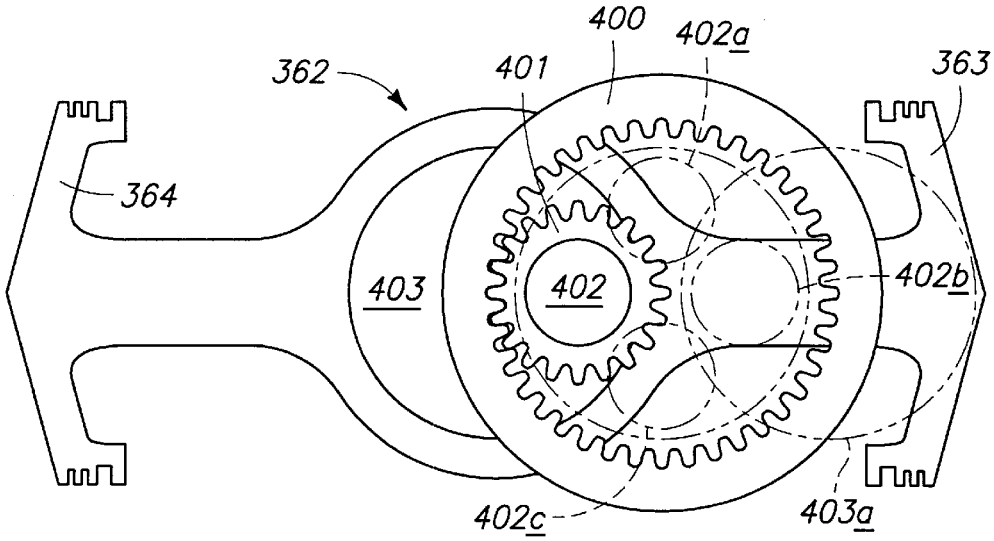
FIG. 19 is a schematic representation of relative positioning of the crankpin gear and internal gear relative to the circular base and crankpin through a stroke of the piston.

FIG. 19 is another schematic depiction of a piston set interacting with internal gear 400, the piston set being numbered 362, similar to that shown in FIG. 17, only showing various positions of the crankpin 402 by the phantom lines, as it moves with crankpin gear 401 clockwise within internal gear 400. The phantom lines illustrate the first crankpin position 402*a* approximately 90 degrees from the original position of crankpin 402. Crankpin 402*b* depicts a second phantom crankpin position 180 degrees from the starting point of crankpin 402 and crankpin 402*c* illustrates a third phantom position for crankpin 402, 270 degrees from the starting position of crankpin 402.

FIG. 19 further illustrates the relative position of circular base 403*a* when the crankpin is at position 402*b*, with circular base 403*a* being shown by phantom lines. This depiction of circular base 403*a* is when the crankpin 402 is at crankpin 402*b* , 180 degrees from the starting position illustrated.

Figure 20:
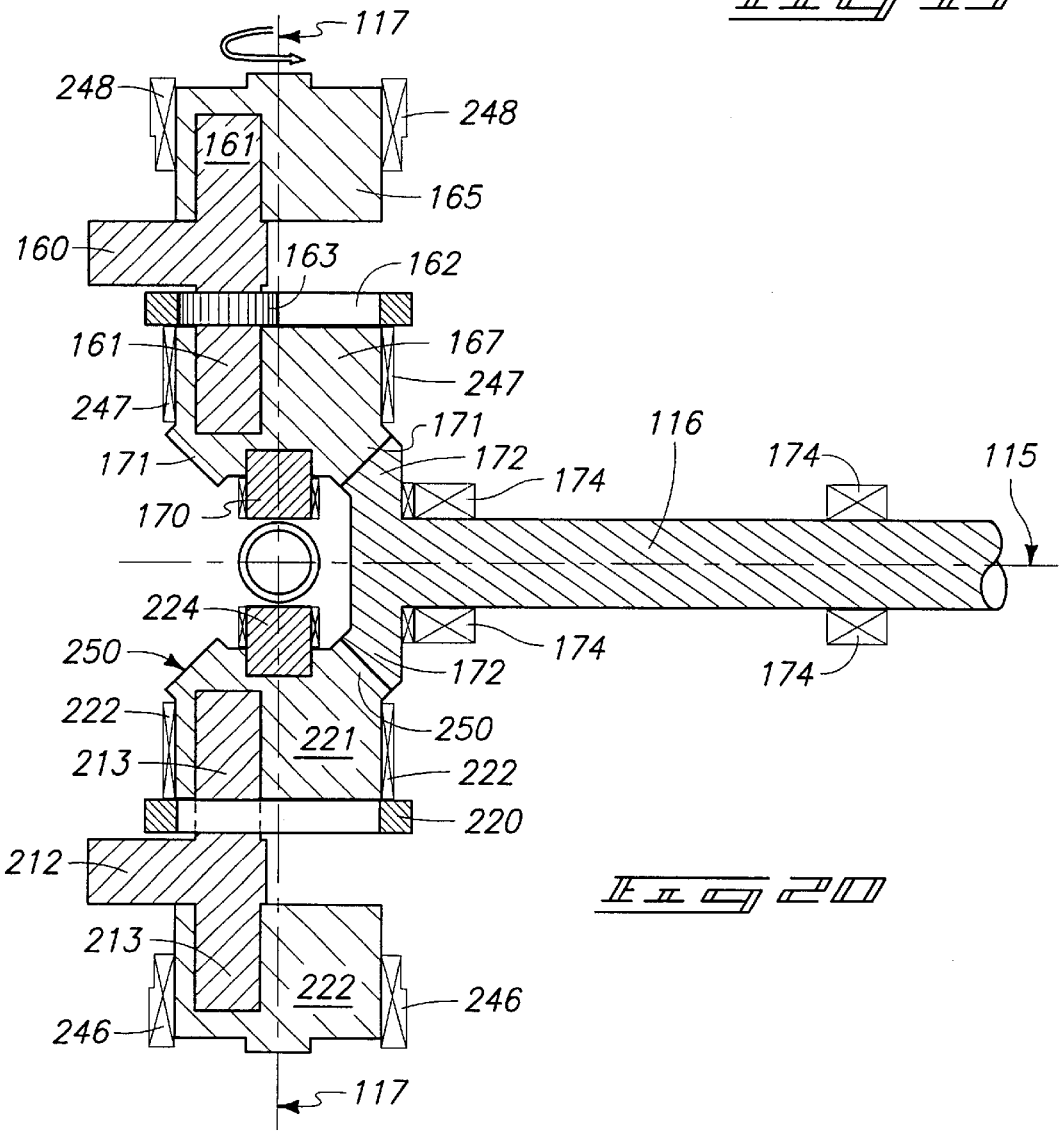
FIG. 20 is a cross-sectional view of an embodiment of a crank set which may be utilized in an embodiment of this invention.

FIG. 20 is a cross sectional view of a crank set layout which may be utilized in an embodiment of this invention. FIG. 20 illustrates central axis 115 of the engine with drive shaft 116 being generally centered about central axis 115. Drive shaft bearings 174 locate and position drive shaft 116 relative to central axis 115 and other components of the engine, pump or compressor. Internal gear 162 and crankpin gear 163 on the upper crank set side are shown, as depicted and explained in more detail in prior figures. Circular base 160 and crankpin 161 are integral or unitary with circular base 160. Not shown is circular base aperture which circular base 160 would generally be rotatably mounted within and driven by. First outer crank module 165 has crankpin 161 eccentrically and rotatably mounted within it and as the piston set forces circular base 160 and crankpin 161 to rotate, this likewise forces first outer crank module 165 to rotate and drive an outer gear mounted thereto in the direction of the arrow shown. The first outer crank module 165 generally and approximately rotates about crank axis 117, which is generally transverse and perpendicular to central axis 115. First outer crank module 165 utilizes bearing 248 to locate and allow rotation thereof.

The opposing or opposite side of crankpin 161 is eccentrically mounted within first inner crank module 167 such that crankpin 161 may rotate within the aperture in which it is received. Forcing the rotation of circular base 160 and crankpin 161 likewise forces the rotation of first inner crank module 167 about crank set axis 117.

It can be seen that first inner crank module 167 interacts with drive shaft gearing 172 to cause rotation of drive shaft 116. The rotation transfer mechanism may be any one of a number of different types of gears or means, all of which are generally known in the field of art.

There is a stabilizing mini shaft 170 fixed to first inner crank module 167 to provide additional stability and location of the rotation, and is generally centered about crank set axis 117. The stabilizing mini shaft 170 is supported and located by pin bearings as shown.

At the lower end of FIG. 20 is the same general configuration as the upper end, illustrating second outer crank module 222 mounted within bearing 246. Crankpin 213 is eccentrically mounted on circular base 212 and rotatably and eccentrically mounted within second outer crank module 222 and eccentrically and rotatably mounted within second inner crank module 221, as shown. Second inner crank module 221 includes second inner crank module gear 250 which interacts with drive shaft gear 172 to provide drive rotation to drive shaft 116. Stabilizing stub shaft 224 is mounted within pin bearings as shown and has similar location and function to stabilizing mini shaft 170 on the upper portion of the crank set as shown.

FIG. 20 also shows second inner crank module bearing 222 and internal gear 220. First inner crank module gear 171 will generally correspond to second inner crank module gear 250 in configuration and interaction with drive shaft gear 172. It will be noted that the eccentrically mounted crankpins 161 and 213 are preferably one piece with circular base 160 and 212 respectfully.

Again, the inner and outer crank modules rotate about the crank axis 117, forcing the circular bases 160 and 212 with eccentrically mounted crankpins 161 and 213 to counter rotate. In general, this embodiment of the invention requires a set of inner and outer crank modules, internal gear set and eccentrically mounted crankpins for each piston set. This engine design has flexibility in that it may easily and equally have a similar set of cylinder sets and crank sets at a ninety degree (90°) angle rotating about central axis 115 to increase the number of cylinders from 4 to 8 in a given application.

Figure 21:
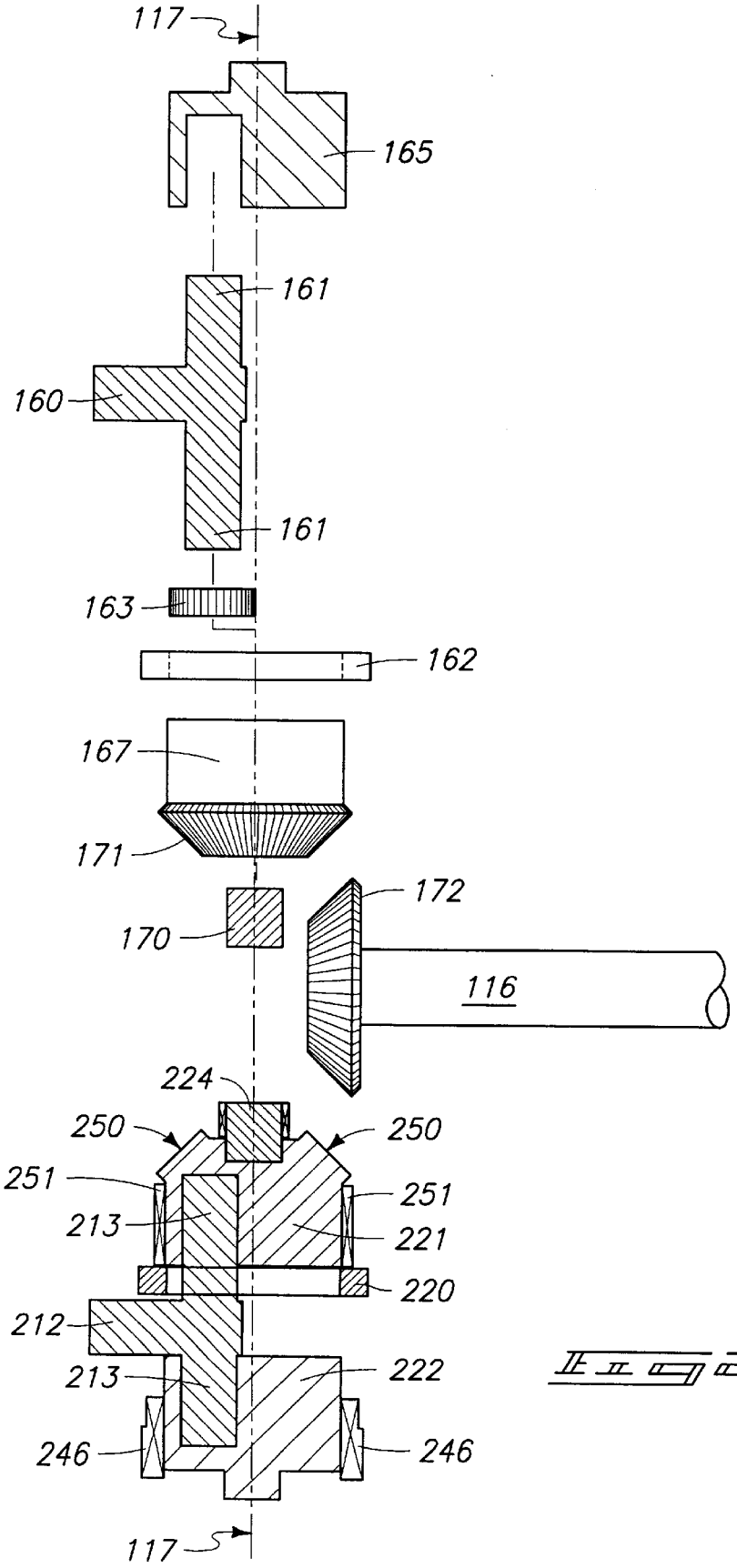
FIG. 21 is an exploded view of an embodiment of a crank system which may be utilized in an embodiment of this invention.

FIG. 21 is an exploded view of the crank set layout for this embodiment of the invention, illustrating first outer crank module 165, circular base 160 with crankpin 161 eccentrically mounted thereon, crankpin gear 163 (which is preferably a spur gear), internal gear 162, first inner crank module 167, first inner crank module gear 171, stabilizing mini-shaft 170 for first inner crank module 167, drive shaft 116 with drive shaft gear 172, second outer crank module 222 mounted and positioned within bearing 246, second circular base 212 with second eccentrically mounted crankpins 213 mounted to second circular base 212. FIG. 21 further shows internal gear 220, second inner crank module 221 with second inner crank module gear 250 thereon, and stabilizing stub shaft 224. The crank set rotates about the crank set axis 117.

First inner crank module gear 171 is preferably a 45-degree beveled gear, sized to accommodate for crank sets about the main drive shaft gear 172. Second inner crank module gear 250 would preferably be the same or approximately the same as first inner crank module gear 171 and interact with drive shaft gear 172 in a similar fashion.

FIG. 22 is an end elevation view of a face plate 209 with first face plate aperture 209*a* and second face plate aperture 209*b* with central aperture 209*c*. The bores 209*a* and 209*b* generally go around the cylinder neck which then rotates face plate 209 with the cylinders. The face plate is preferably spring loaded to help seal the intake and exhaust ports when the ports are not communicating with transfer ports in the respective cylinder sets. The face plate surface that is sliding on the port plate would preferably be highly polished and lubricated depending on the specific application and materials used. Again, the face plate rotates with the cylinders and the seals and ports are cut out on the port plate which is immovably mounted on the end plate. The face plate is preferably equipped with an oil supply and scrapers for excess oil for sealing and lubrication purposes.

Figure 23:
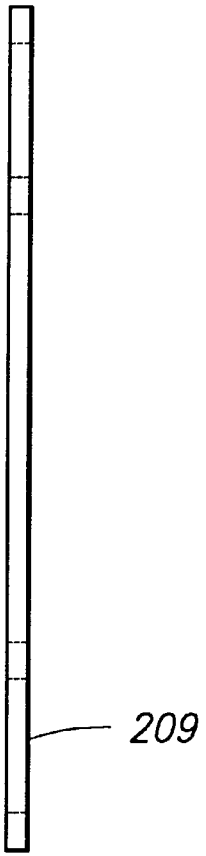
FIG. 23 is a front elevation view of the face plate shown in FIG. 22.

FIG. 23 is a front elevation view of face plate 209. While the face plate shown is the preferred way to achieve lubrication and interaction of surfaces and ports at the time of filing, this may be done in any one of a number of different ways at the rear end plate, front end plate, or otherwise, all within the contemplation of this invention.

Figure 24:
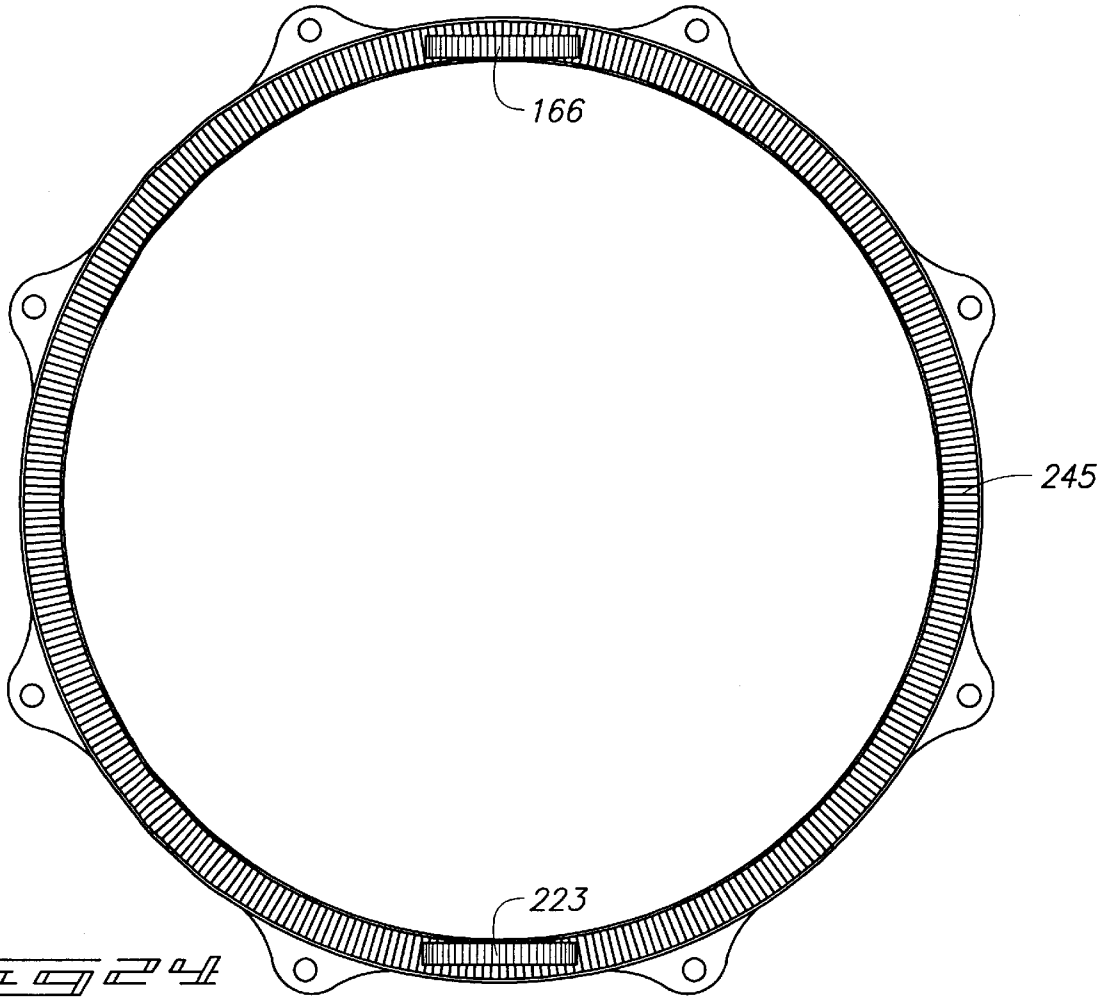
FIG. 24 is an end elevation view of a ring gear which may be utilized in an embodiment of this invention, and further illustrates outer gears which may interact with the ring gear.

FIG. 24 is an end elevation view of the ring gear which is generally situated about the rotating perimeter of the engine, also shown in FIG. 2 as item 245. The ring gear has gearing on one or both sides and outer crank module gears 166 and 223, as also shown in FIG. 2, interact with ring gear 245 to drive part or all of the rotation of the engine about its central axis. The interaction of the outer crank module gears 166 and 223 provides a driving force to rotate the cylinder set and piston sets around the central axis of the engine at a gear ratio of approximately 1 to 6, which would be the final output shaft of the engine or drive shaft. The approximate center of ring gear 245 will also be the approximate central axis of the engine. It will also be appreciated that the ring gear is stationary and does not rotate with the engine, but instead the two outer crank module gears 166 and 223 force the rotation of the engine through interaction with ring gear 245. The ring gear is also provided with bolt holes for locating and fastening the ring gear to an outer housing.

It is preferable in a four-cylinder embodiment of this invention that there be two outer crank module gears 166 and 223 mounted 180 degrees apart. However, in the eight-cylinder embodiment of this invention, there would be four such outer crank module gears, each preferably and sequentially mounted 90 degrees apart from one another. The two outer crank module gears 166 and 223 generally rotate in opposite directions from one another, thereby forcing the cylinder set to rotate about the central axis of the engine.

Figure 25:
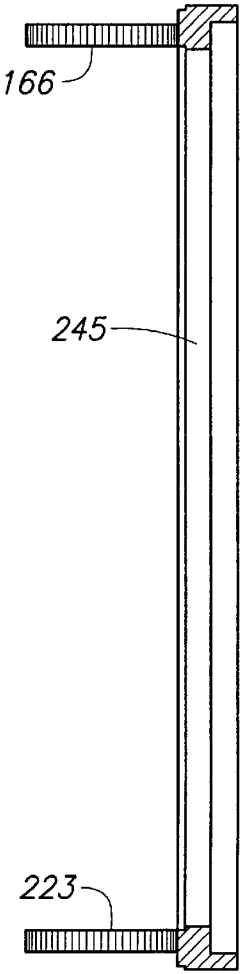
FIG. 25 is a front elevation view of the ring gear and outer gears illustrated in FIG. 24.

FIG. 25 is a front elevation view of ring gear 245 and first outer crank module gear 166 and second outer crank module gear 223, as also shown in FIG. 24.

Figure 26:
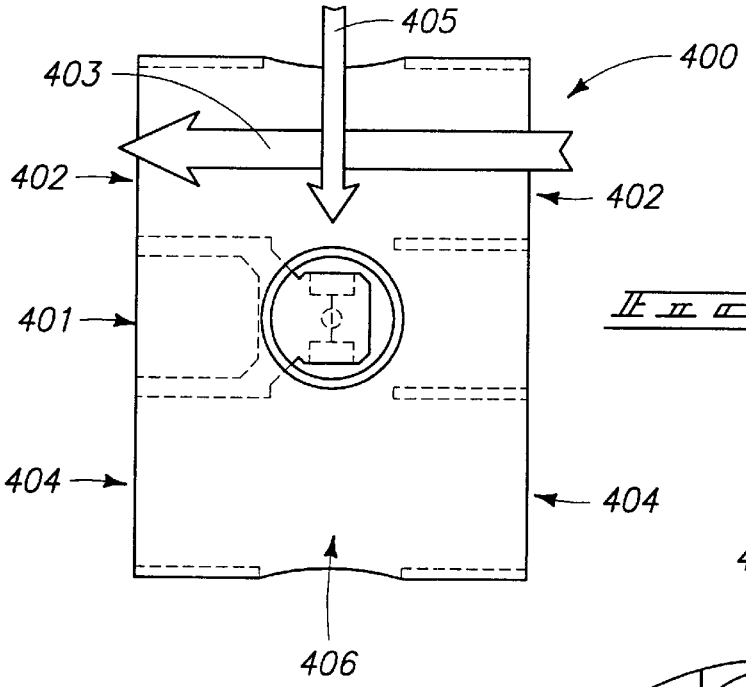
FIG. 26 is a front elevation schematic representation of a block which may be utilized in an embodiment of this invention.

FIG. 26 is a front elevation view of one embodiment of the cylinder block 400 which may be utilized in embodiments of this invention. FIG. 26 illustrates blind hole bore 401, first cylinder through bore 402 with arrow 403 illustrating the through bore, second cylinder through bore 404 through cylinder block 400. Crank set bore 405 is also shown on the upper half, and a corresponding crank bore hole 406 is shown on the lower half of the cylinder block 400 illustrated in FIG. 26. It will be appreciated that first cylinder bore 402 intersects crank set bore 405 and second cylinder bore 404 intersects with second crank set bore 406.

Figure 27:
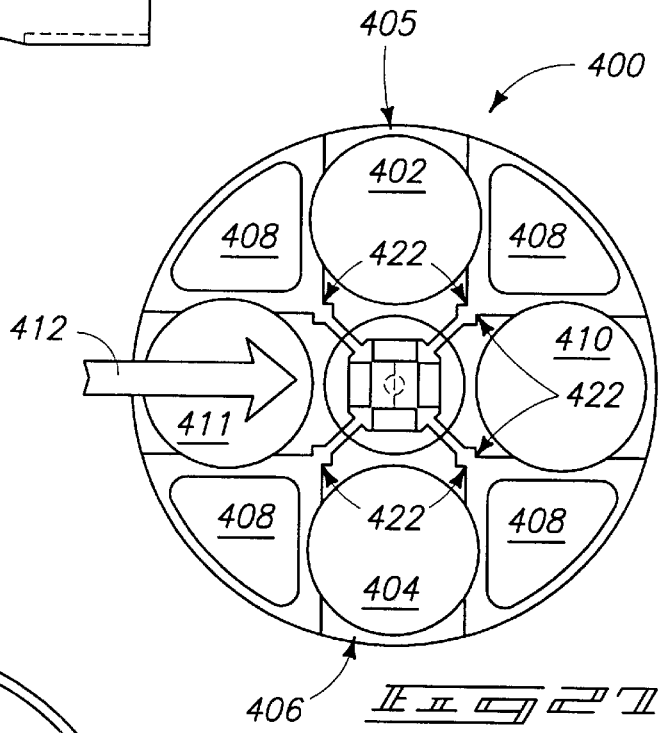
FIG. 27 is a first end elevation schematic representation of the block illustrated in FIG. 26.

FIG. 27 is a right end view of the cylinder block 400 illustrated in FIG. 26, illustrating first cylinder bore 402, second cylinder bore 404, cutouts 408 which are merely portions where metal or material are cut out to reduce the overall weight of the cylinder block. FIG. 27 illustrates a more universal cylinder block 400 because two additional cylinder bores 410 and 411 are shown and would not be utilized in the four-cylinder embodiment of this invention. Instead, third cylinder bore 410 and fourth cylinder bore 411 would be utilized in an eight-cylinder embodiment of this invention. It should also be noted that cylinder block 400 would rotate about the central axis of the engine. Additionally, in the eight-cylinder version and in the preferred universal cylinder block, transverse crank set bores would be provided for the additional two cylinders, for example transverse crank set bore 412 would be similar in nature to crank set bores 405 and 406.

FIG. 27 further illustrates shoulders 422 where the internal gear shown and described in prior figures may be located or mounted.

Figure 28:
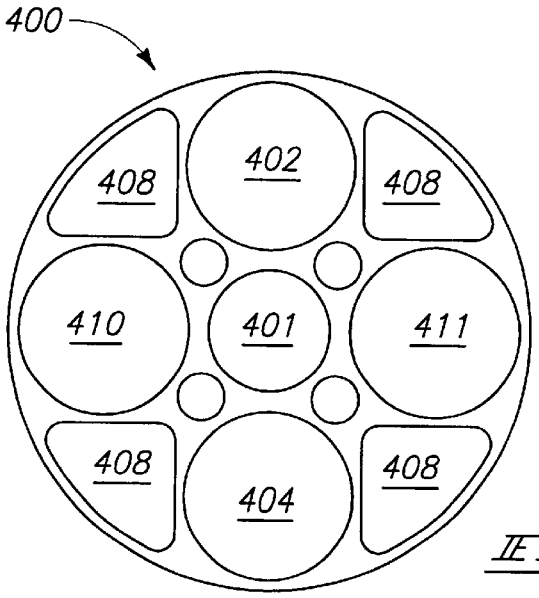
FIG. 28 is a second end elevation schematic representation of the block illustrated in FIG. 26.

FIG. 28 is a left end view of the embodiment of the cylinder block 400 illustrated in FIG. 26, illustrating blind hold bore 401, first cylinder bore 402, second cylinder bore 404, third cylinder bore 410, and fourth cylinder bore 411, with cutouts 408 also shown as through cutouts.

It will be appreciated by those of ordinary skill in the art that there is no particular cylinder or cutout configuration that is required to practice the cylinder block portion for this embodiment of the invention, but any one of a number of configurations as well as materials may be used, all as contemplated.

Figure 29:
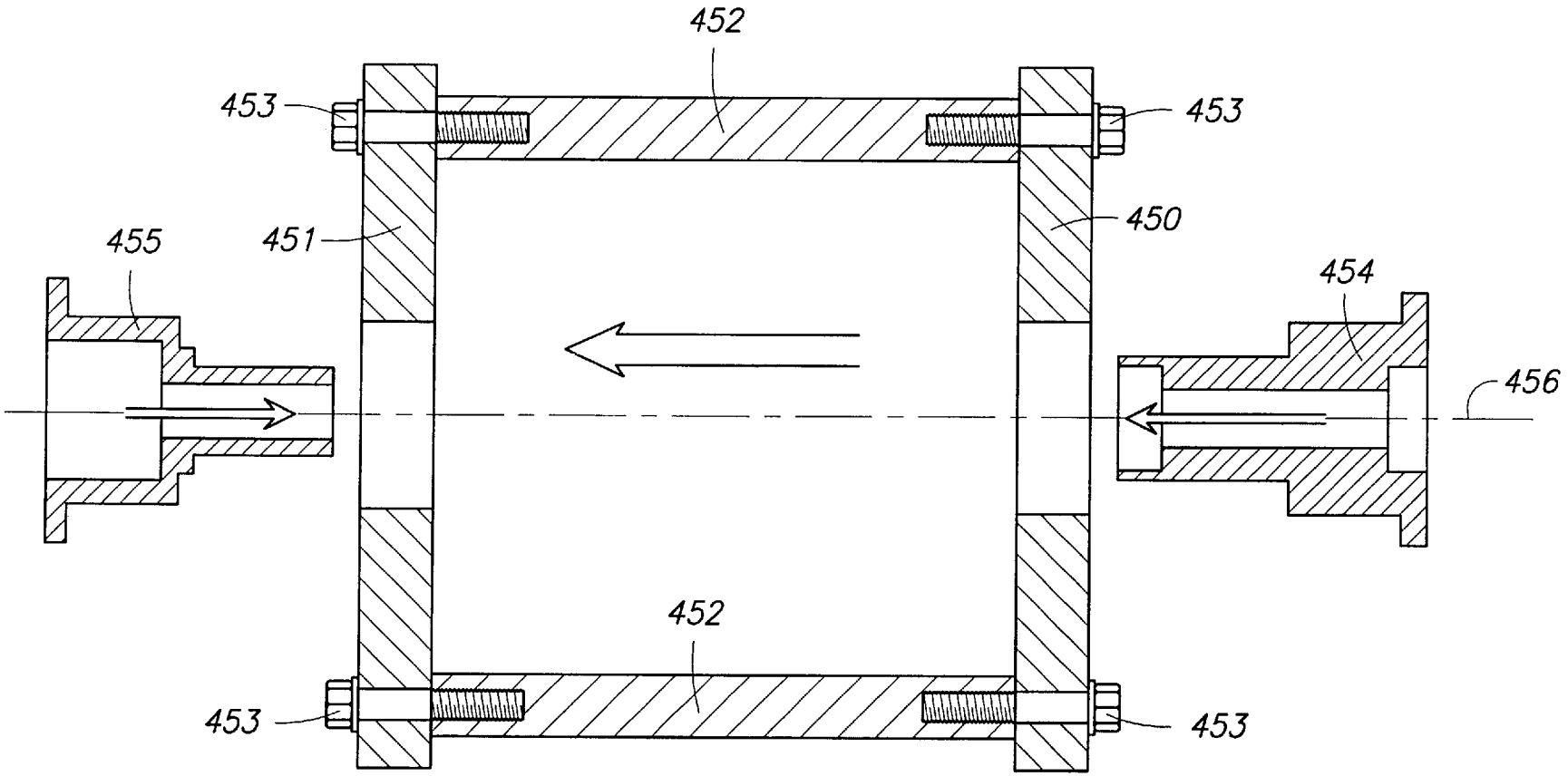
FIG. 29 is a front elevation schematic representation of an embodiment of an end plate framework configuration, with front bearing and driveshaft mounts, which may be utilized in an embodiment of this invention.

FIG. 29 is a front elevation view showing the interaction of end plates with bearing mounts which may be utilized for the drive shaft or other components. FIG. 29 illustrates rear end plate 450, front end plate 451, spacer dowels 452, frame bolts 453, drive shaft mount 454, front bearing mount 455 and central axis 456 about which the engine rotates.

FIG. 30 through 35 illustrate the cycling of an embodiment of a piston set contemplated by this invention with an embodiment of a cylinder set and with the internal gear configuration illustrated in this embodiment. Each of FIGS. 30 through 35 illustrates or shows a cylinder set which includes first cylinder 500 with first cylinder cavity 502 (combustion chamber), transfer port 503, first cylinder terminal end 501, first cylinder proximal end 499, second cylinder 504 which includes second cylinder internal cavity 505, second cylinder proximal end 513, second cylinder terminal end 514, and second cylinder transfer port 506.

Each of FIGS. 30 through 35 also shows a piston set which includes first piston 507, second piston 508 and crank related mechanisms such as circular base 509, crankpin 510 eccentrically mounted on circular base 509 within a circular aperture in the piston set, crankpin gear 511 fixed to eccentric pin 510 and internal gear 512.

Since all like items are numbered identically in FIGS. 30 through 35, they will not be repeated herein.

Figure 30:
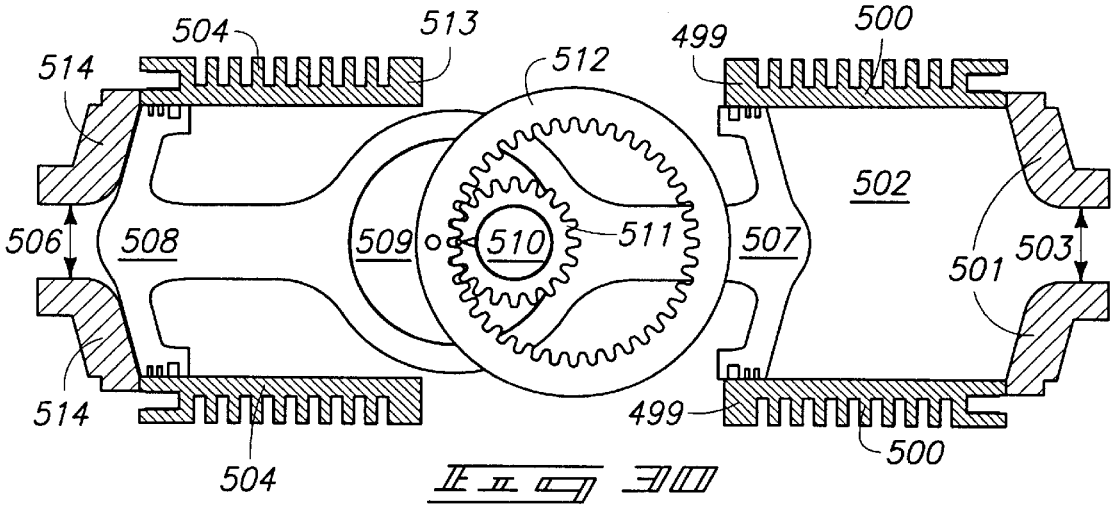
FIGS. 30–35 are schematic illustrations of examples the piston set and crank set movements within the cylinder set at various stages in the cycle, as may be utilized in one embodiment of the invention.
Figure 31:
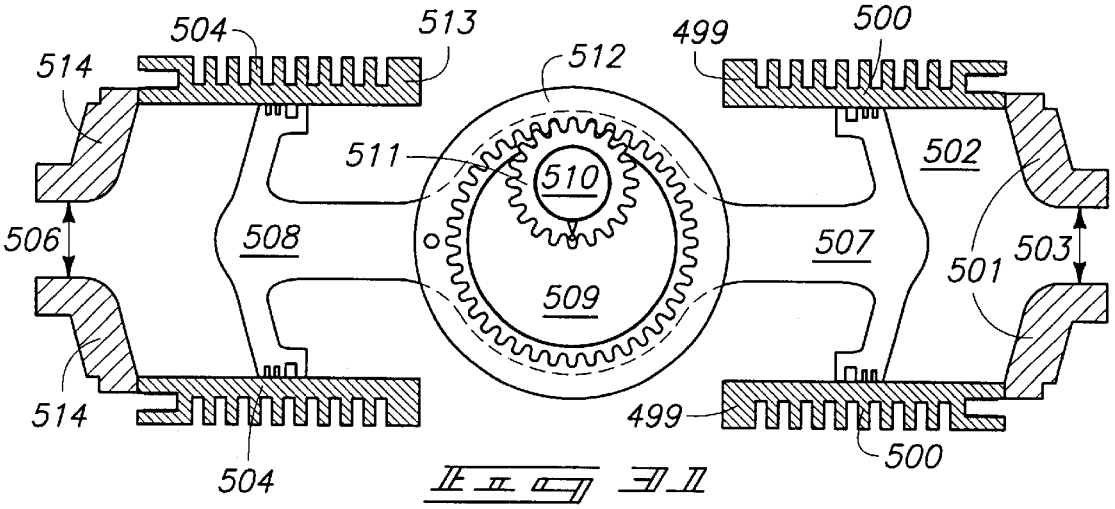
Figure 32:
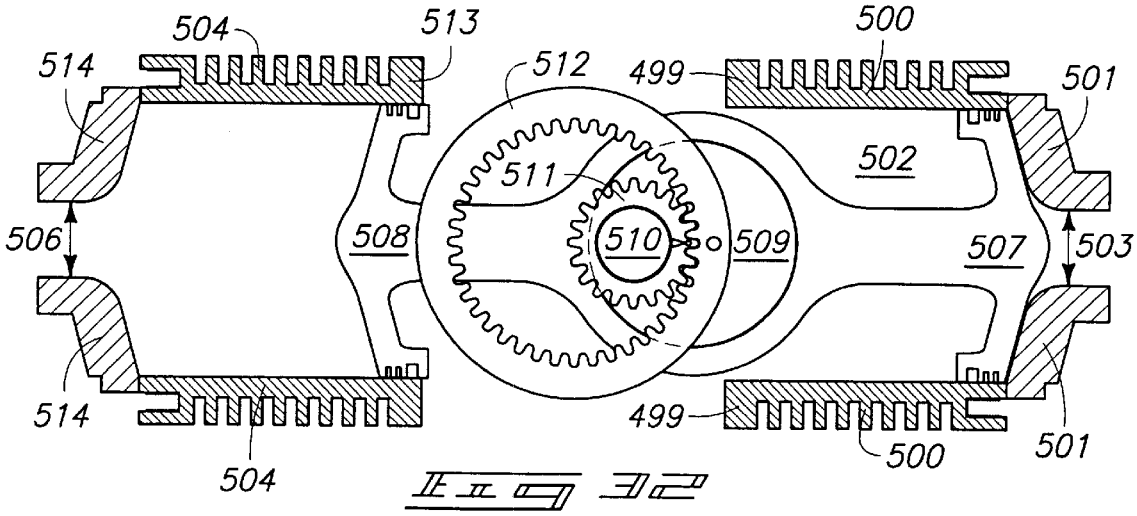
Figure 33:
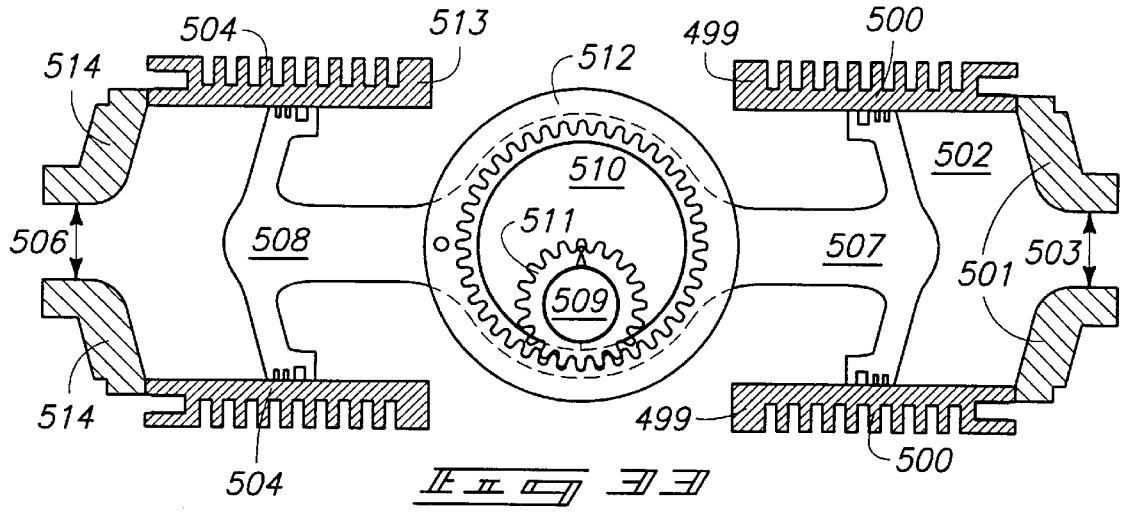
Figure 34:
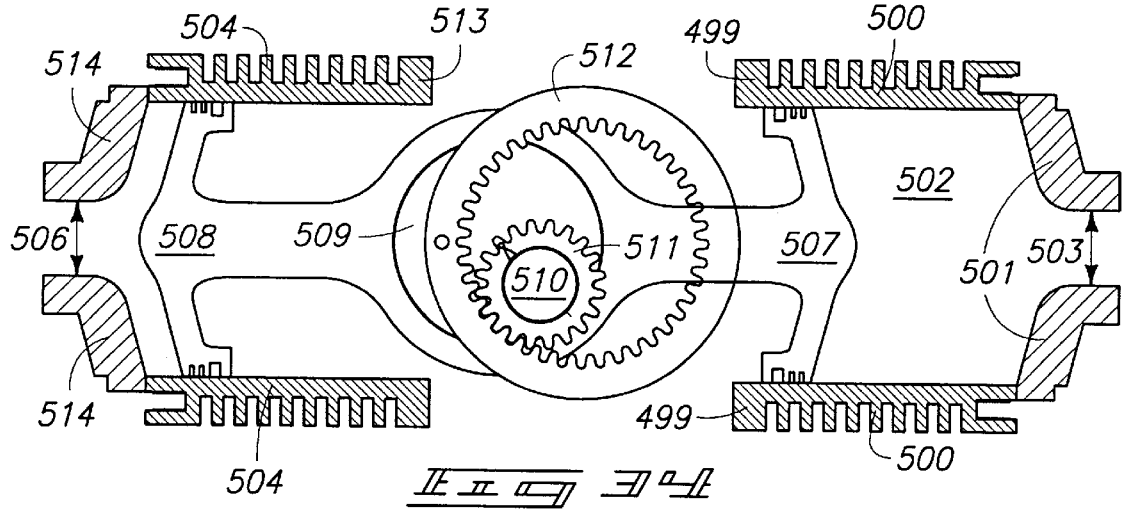
Figure 35:
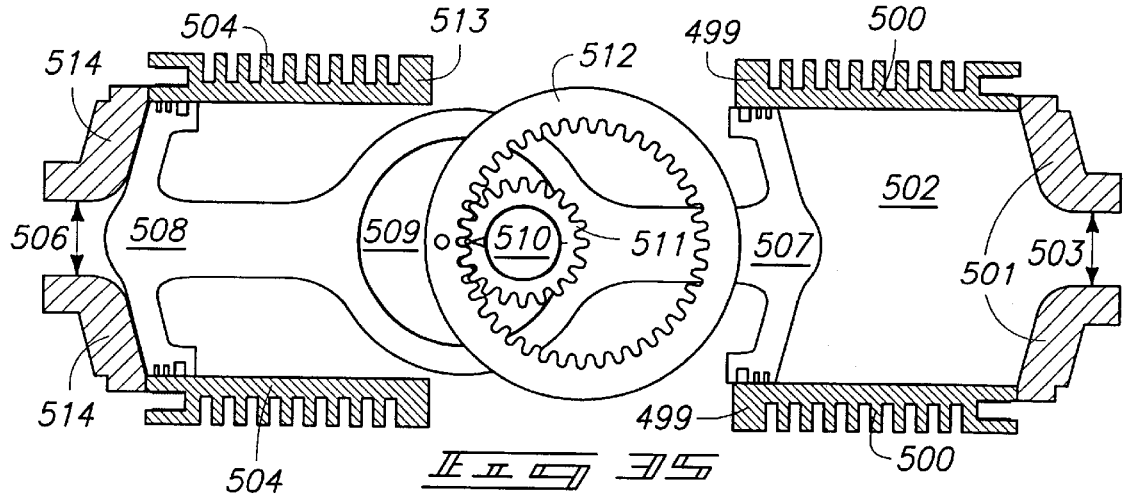
Figure 31:
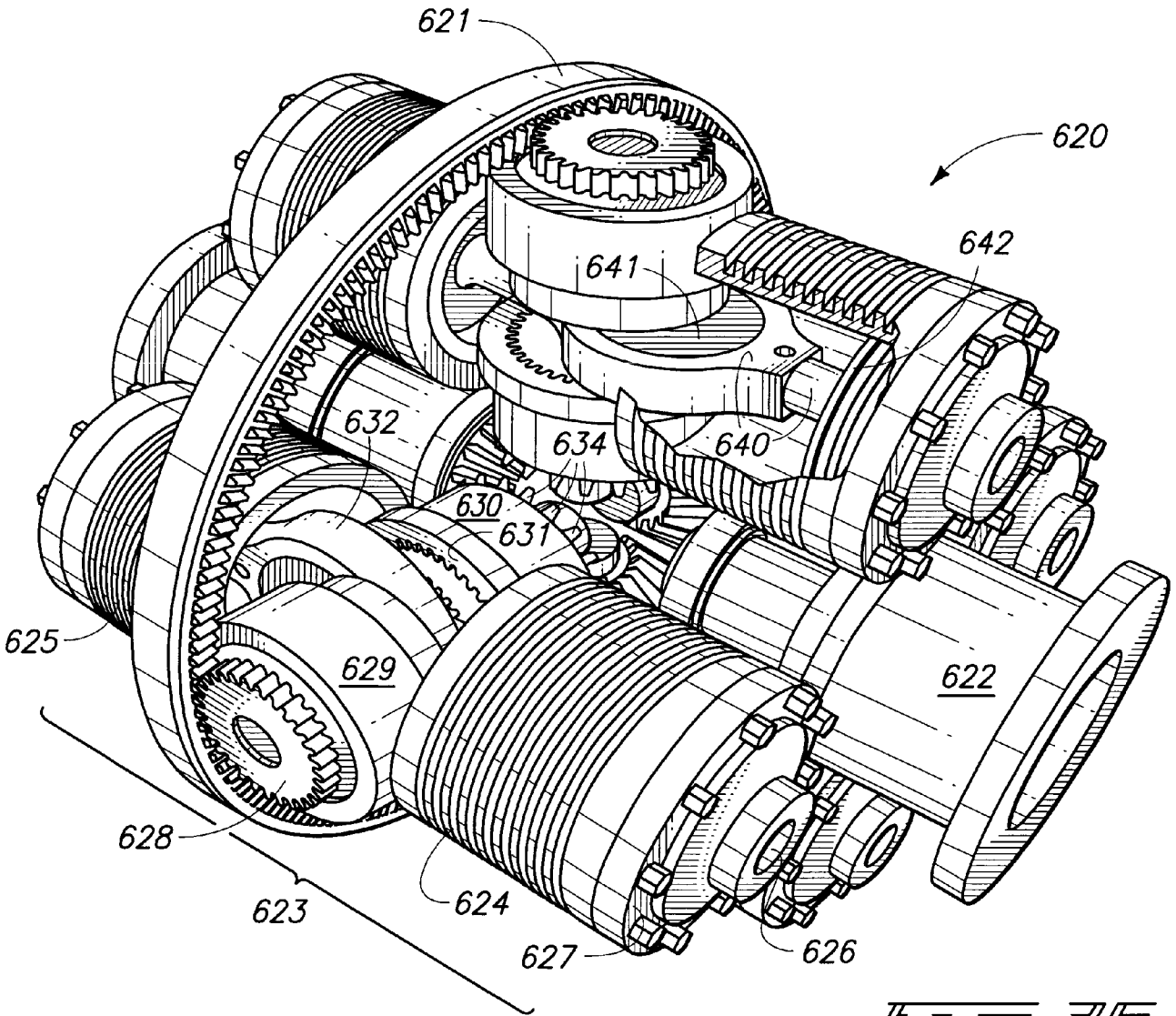

FIG. 30 is shown as a theoretical starting point for the cycling of the piston set within the cylinder set. FIG. 31 is a depiction of the cylinder and piston configuration wherein crankpin 510 has rotated 90 degrees within internal gear 512. FIG. 32 illustrates a 180 degree rotation of crankpin 510; FIG. 33 illustrates a 270 degree rotation of crankpin 510; FIG. 34 illustrates an approximate 315 degree rotation or movement of crankpin 510; and FIG. 35 illustrates a 360 degree rotation of crankpin 510 within internal gear 512. FIGS. 30 through 35 therefore show a complete rotation of crankpin 510 and the relative position of circular base 509, crankpin gear 511 and relative to first piston 507 and second piston 508.

FIG. 36 is a perspective view of an embodiment of this invention which utilizes eight cylinders, or four cylinder sets. FIG. 36 illustrates ring gear 621, which is preferably stationary, drive shaft mount 622, outer crank module gear 628 on cylinder set 623. The cylinder set represented by item 623 includes a first cylinder 624, a second cylinder 625, outer crank module 629, piston rod 632, circular base 641, internal gear 631, terminal end 627 of first cylinder 624, transfer port 626 for first cylinder 624, inner crank module 630 with gears 634 thereon.

In the embodiment of the engine 620 shown in FIG. 36, a breakaway view within cylinder 650 better illustrates piston head 642, piston rod 640 and circular base 641.

Figure 37:
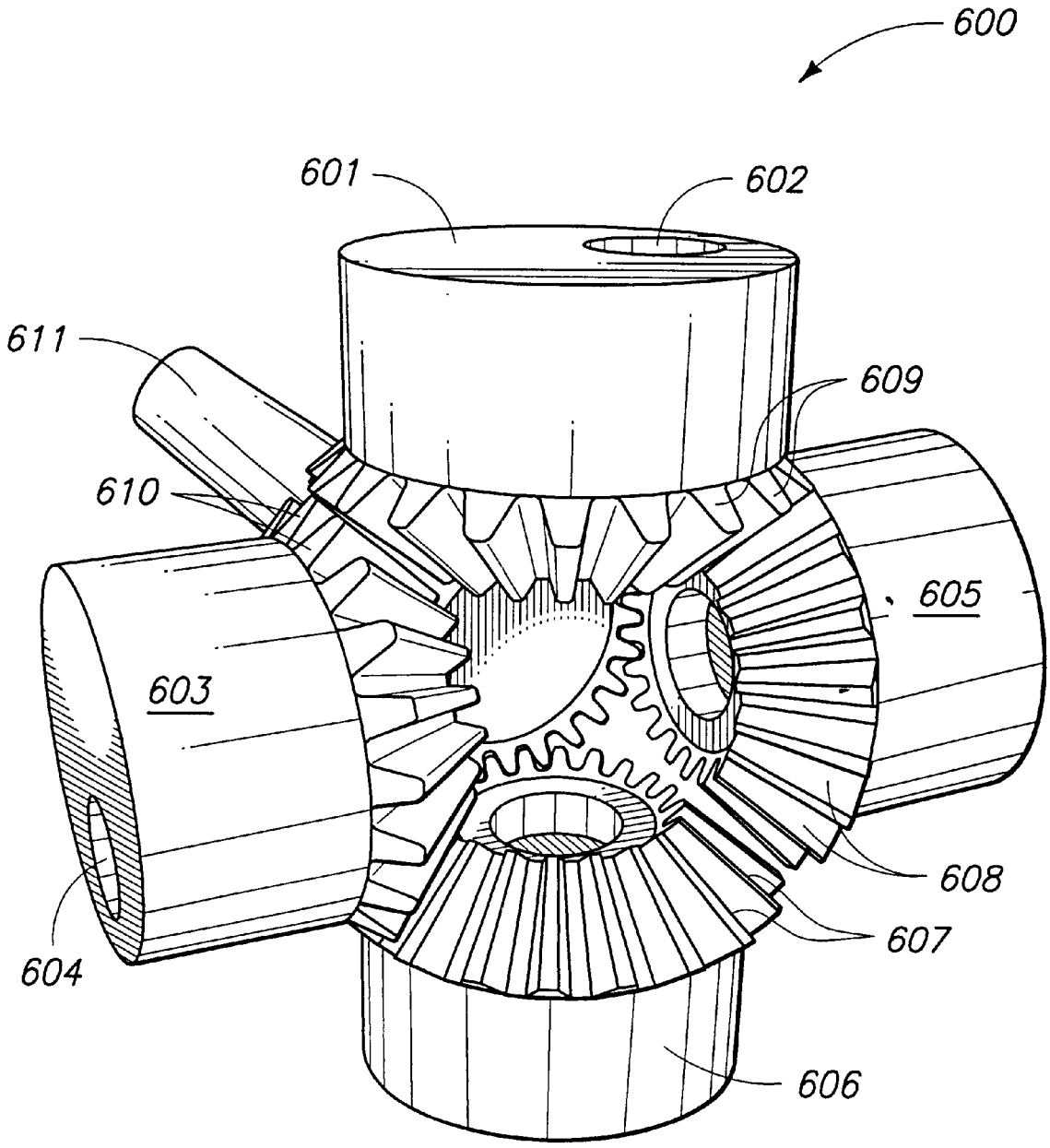
FIG. 37 is a perspective view of an embodiment of a gear cluster which may be utilized in this invention.
Figure 11:
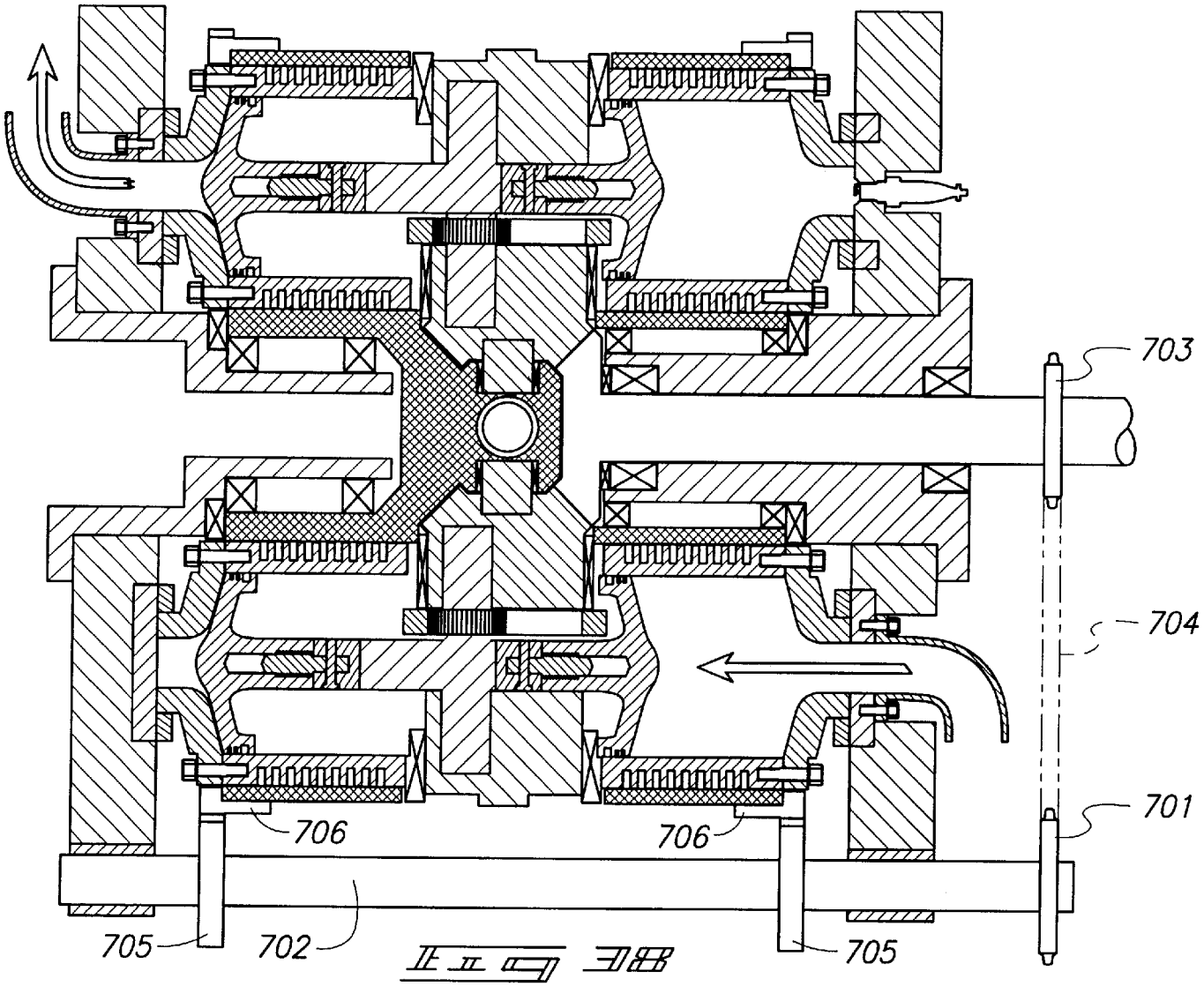
Figure 5E:
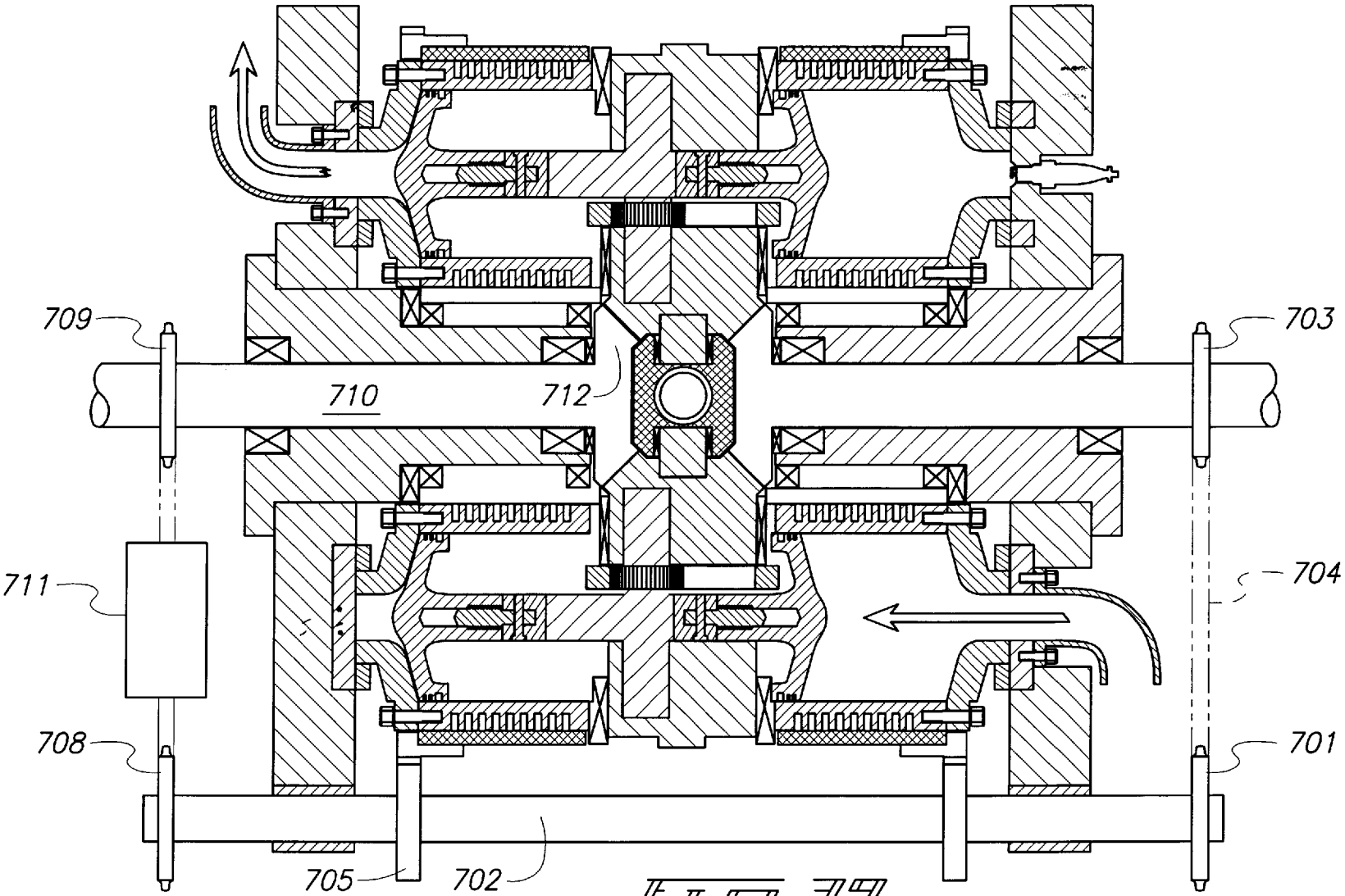

FIG. 37 is a perspective view of an embodiment of a gear cluster which may be utilized by this invention, showing an eight cylinder embodiment of an engine, pump or compressor gear cluster. The gear cluster 600 is shown with inner crank modules 601, 603, 605 and 606, each having gears 609, 610, 607 and 608 respectively thereon. The inner crank modules have eccentrically positioned apertures 602 and 604 (with the apertures not shown for inner crank module 605 and 606), and drive shaft 611. The preferred ratio of rotation for the inner crank modules versus the drive shaft 611 are six-to-five (6:5). It should be noted it is preferred that the ratio be greater than one for relative sizing and interaction, although no one particular ratio is required to practice this invention.

FIG. 38 is a cross-sectional view of another embodiment of an engine contemplated by this invention, in which the rotation of the engine is via external gearing as shown. FIG. 38 is the same as FIG. 2 in many respects and each like component will therefore not be separately identified and described relative to FIG. 38. However, FIG. 38 does further illustrate an engine rotation system which utilizes a rotation gear 701 or sprocket mounted on or to a rotation gear shaft 702, the rotation gear shaft 702 being rotatably mounted to the end-plates in this embodiment. The rotation gear 701 may be a gear, sprocket for receiving a chain, or any other mechanical configuration for transferring/receiving rotation from the drive shaft, all within the contemplation of this invention.

Although the rotation gear 701 is shown operatively attached or rotatably coupled to drive shaft gear 703 via chain 704, it may be operatively or rotatably attached in any one of a number of different ways within the contemplation of this invention. The rotation of the drive shaft and consequently the drive shaft gear 703, causes the rotation gear 701 and the rotation gear shaft 702 to rotate, which in turn rotates block drive gears 705. Block drive gears 705 are operatively attached to and drive block gears 706 and the rotation of the block drive gears 705 thereby rotates the engine block, cylinder sets, etc. about the drive shaft axis. It is preferable that the gear or sprocket ratio between drive shaft gear 703 and rotation gear be a six-to-one (6:1) ratio in the embodiment shown. In this embodiment, this results in the block and cylinder sets rotating once about the central axis for every six rotations of the driveshaft. It should also be noted that in this embodiment, the outer crank gear and the ring gear as shown and described relative to FIG. 2 has been replaced with the configuration shown.

FIG. 39 is a cross-sectional view of another embodiment of an engine contemplated by this invention, in which the rotation of the engine is via external gearing as shown. FIG. 39 is the same as and/or similar to FIG. 2 and FIG. 38 in many respects and each like component will therefore not be separately identified and described relative to FIG. 2 and/or FIG. 38. FIG. 39, like FIG. 38, does further illustrate an engine rotation system which utilizes a rotation gear 701 or sprocket mounted on or to a rotation gear shaft 702, the rotation gear shaft 702 being rotatably mounted to the end-plates in this embodiment.

FIG. 39 illustrates an embodiment of this invention which utilizes an additional gear in the gear cluster, a cluster rotation gear 712, and a differential in the rotation of cluster rotation gear 712, a block rotation gear, versus the rotation of the drive shaft, at a preferred 6:5 ratio, to achieve the rotation of the block. The configuration in FIG. 39 is an embodiment showing another way to rotate the engine block, illustrating second rotation gear 708 or sprocket, is operatively connected to cluster rotation gear shaft 710 via gear or sprocket 709, such that the cluster rotation gear shaft 710 and the cluster rotation gear 712 rotate in the opposite or reverse direction of rotation gear shaft 702.

Mechanism 711 merely depicts any mechanism which may be used to reverse the rotation between the rotation gear shaft 702 and the cluster rotation gear shaft 710. This mechanism may be by gearing or any other known means.

Also as stated above relative to FIG. 2, the relative rotation between the cylinders and the transfer ports in the cylinder relative to the intake and exhaust ports in the port plates and/or end plates is utilized as the valving function, and that may be accomplished within the contemplation of this invention by rotating the block and the cylinders, by rotating the port plates, or by rotating the framework or end plates, or some combination thereof.

As will be appreciated by those of reasonable skill in the art, there are numerous embodiments to this invention, and variations of elements and components which may be used, all within the scope of this invention.

For example, in one embodiment of the invention, a rotary engine, pump or compressor is provided which comprises: a stationary framework comprising a first port plate at a first side of the framework and a second port plate at a second side of the framework and fixed relative to the first port plate, each port plate comprising an intake port and an exhaust port through the port plate; a block rotatably mounted relative to the stationary framework and about a central axis; a first cylinder set and a second cylinder set mounted in the block in opposing relation from one another about the central axis, each cylinder set comprising: a first cylinder and an opposing second cylinder, each cylinder comprising a proximal end and a terminal end having a transfer port disposed to alternately form a passageway with the intake port and the exhaust port in the port plate; a first piston set movably mounted within the first cylinder set and a second piston set movably mounted within the second cylinder set, the first and second piston sets each comprising: a first piston in the first cylinder and a second piston in the second cylinder, each piston comprising a piston head with a piston face and a piston rod having a first end mounted to the piston head, wherein the piston rods are operatively attached to one another; a first crankset driven by the first piston set and a second crankset driven by the second piston set, the first crankset and the second crankset each comprising: a crankpin eccentrically mounted to the piston set to rotate about a crankpin axis; a crankpin gear fixed to the crankpin; an internal gear fixed relative to the first cylinder set, the internal gear having an internal gear configured to mate with the crankpin gear as the crankpin gear rotates within the internal gear; wherein the eccentric rotation of the crankpin offsets the rotation of the crankpin gear within the internal gear to provide approximately linear movement of the piston heads within the first and second cylinders and such that the crankpin also rotates about a crankset axis; an inward side of the crankpin being eccentrically mounted to an inner crank gear, such that the rotation of the crankpin also rotates the inner crank gear about the crankset axis; wherein the generally linear movement of the circular base aperture of the piston set drives the crankpin gear to rotate around within the internal gear, thereby driving the crankpin to rotate about the crankpin axis; and the inner crank gear mating with a driveshaft gear such that the rotation of the inner crank gear rotates the driveshaft.

In further embodiments to that disclosed in the preceding paragraph, a rotary engine, pump or compressor is provided, which further comprises a rotation gear rotatably mounted relative to the stationary framework and operatively attached to and driven by the driveshaft, and further wherein the rotation gear is disposed to drive the rotation of the block. In other further aspects of the invention to the preceding: a block drive gear is provided and driven by the rotation gear, the block drive gear operatively interacting with the block to drive the rotation of the block; or the block drive gear may operatively interact with the block to drive the rotation of the block via a block gear integral with the block and which corresponds to and is driven by the block drive gear; and still further, the rotation gear and the block drive gear may be integral.

While there are multiple possible ratios of rotation between the rotation gear and the driveshaft, an embodiment of the invention utilizes a rotation ratio of six-to-five. Still further embodiments of these embodiments of the invention may further comprise an ignition device mounted to each of the first port plate and the second port plate such that rotation of the transfer port about the central axis causes the transfer port to form a passageway with the sparking device, and further wherein the ignition device is a spark plug. Further aspects of this may include configurations wherein the transfer port at the terminal end of each cylinder is disposed to alternately form a passageway with the intake port and the exhaust port in the port plate.

Another embodiment of this invention, for example, is a rotary engine, pump or compressor comprising: a stationary framework comprising a first port plate at a first side of the framework and a second port plate at a second side of the framework and fixed relative to the first port plate, each port plate comprising an intake port and an exhaust port through the port plate; a block rotatably mounted relative to the stationary framework and about a central axis; a first cylinder set and a second cylinder set mounted in the block in opposing relation from one another about the central axis, each cylinder set comprising: a first cylinder and an opposing second cylinder, each cylinder comprising a proximal end and a terminal end having a transfer port disposed to alternately form a passageway with the intake port and the exhaust port in the port plate; a first piston set movably mounted within the first cylinder set and a second piston set movably mounted within the second cylinder set, the first and second piston sets each comprising: a first piston in the first cylinder and a second piston in the second cylinder, each piston comprising a piston head with a piston face and a piston rod having a first end mounted to the piston head, wherein the piston rods are operatively attached to one another; a first crankset driven by the first piston set and a second crankset driven by the second piston set, the first crankset and the second crankset each comprising: a crankpin eccentrically mounted to the piston set to rotate about a crankpin axis; a crankpin gear fixed to the crankpin; an internal gear fixed relative to the first cylinder set, the internal gear having an internal gear configured to mate with the crankpin gear as the crankpin gear rotates within the internal gear; wherein the eccentric rotation of the crankpin offsets the rotation of the crankpin gear within the internal gear to provide approximately linear movement of the piston heads within the first and second cylinders and such that the crankpin also rotates about a crankset axis; an outward side of the crankpin being eccentrically mounted to an outer crank gear, such that the rotation of the crankpin also rotates the outer crank gear about the crankset axis; an inward side of the crankpin being eccentrically mounted to an inner crank gear, such that the rotation of the crankpin also rotates the inner crank gear about the crankset axis; wherein the generally linear movement of the circular base aperture of the piston set drives the crankpin gear to rotate around within the internal gear, thereby driving the crankpin to rotate about the crankpin axis; the inner crank gear mating with a driveshaft gear such that the rotation of the inner crank gear rotates the driveshaft; the outer crank gear mating with a stationary ring gear around the first and second cylinder sets such that the rotation of the outer crank gear against the ring gear drives the rotation of the first cylinder set and the second cylinder set around the central axis.

In a further embodiment of the embodiment described in the preceding paragraph, a rotary engine, pump or compressor and further comprises an ignition device mounted to each of the first port plate and the second port plate such that rotation of the transfer port about the central axis causes the transfer port to form a passageway with the sparking device; wherein the ignition device is a spark plug; wherein the transfer port at the terminal end of each cylinder is disposed to alternately form a passageway with the intake port and the exhaust port in the port plate, comprising: a circular base aperture between the first and second piston rods; and wherein the first crankset and the second crankset each comprise: the crankpin eccentrically mounted to a circular base mounted within the circular base aperture, the circular base disposed to rotate about a crankpin axis, the crankpin rotating about both the crankpin axis and the crankset; further wherein the circular base aperture is integral with the first and second piston sets; wherein the crankpin gear is in fixed relation to the crankpin by mounting it to the crankpin; wherein the crankpin gear is in fixed relation to the crankpin by mounting it around the crankpin; wherein the outward side of the crankpin is eccentrically and rotatably mounted in an outer crank module which is operatively attached to the outer crank gear, such that the rotation of the crankpin rotates the outer crank module and the outer crank gear about the crankset axis; wherein the inward side of the crankpin is eccentrically and rotatably mounted in an inner crank module which is operatively attached to the inner crank gear, such that the rotation of the crankpin rotates the inner crank module and the inner crank gear about the crankset axis; and/or wherein the first cylinder set and the second cylinder are defined by apertures in the block.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A rotary engine, pump or compressor, comprising:

a stationary framework comprising a first port plate at a first side of the framework and a second port plate at a second side of the framework and fixed relative to the first port plate, each port plate comprising:

an intake port and an exhaust port through the port plate;

a block rotatably mounted relative to the stationary framework and about a central axis;

a first cylinder set and a second cylinder set mounted in the block in opposing relation from one another about the central axis, each cylinder set comprising:

a first cylinder and an opposing second cylinder, each cylinder comprising a proximal end and a terminal end having a transfer port disposed to alternately form a passageway with the intake port and the exhaust port in the port plate;

a first piston set movably mounted within the first cylinder set and a second piston set movably mounted within the second cylinder set, the first and second piston sets each comprising:

a first piston in the first cylinder and a second piston in the second cylinder, each piston comprising a piston head with a piston face and a piston rod having a first end mounted to the piston head, wherein the piston rods are operatively attached to one another;

a first crankset driven by the first piston set and a second crankset driven by the second piston set, the first crankset and the second crankset each comprising:

a crankpin eccentrically mounted to the piston set to rotate about a crankpin axis;

a crankpin gear fixed to the crankpin;

an internal gear fixed relative to the first cylinder set, the internal gear having an internal gear configured to mate with the crankpin gear as the crankpin gear rotates within the internal gear;

wherein the eccentric rotation of the crankpin offsets the rotation of the crankpin gear within the internal gear to provide approximately linear movement of the piston heads within the first and second cylinders and such that the crankpin also rotates about a crankset axis;

an inward side of the crankpin being eccentrically mounted to an inner crank gear, such that the rotation of the crankpin also rotates the inner crank gear about the crankset axis;

wherein the generally linear movement of the circular base aperture of the piston set drives the crankpin gear to rotate around within the internal gear, thereby driving the crankpin to rotate about the crankpin axis; and the inner crank gear mating with a driveshaft gear such that the rotation of the inner crank gear rotates the driveshaft.

2. The rotary engine, pump or compressor as recited in claim 1, and which further comprises a rotation gear rotatably mounted relative to the stationary framework and operatively attached to and driven by the driveshaft, and further wherein the rotation gear is disposed to drive the rotation of the block.

3. The rotary engine, pump or compressor as recited in claim 2, and further comprising a block drive gear driven by the rotation gear, the block drive gear operatively interacting with the block to drive the rotation of the block.

4. The rotary engine, pump or compressor as recited in claim 2, and wherein the block drive gear operatively interacts with the block to drive the rotation of the block via a block gear integral with the block and which corresponds to and is driven by the block drive gear.

5. The rotary engine, pump or compressor as recited in claim 4, and further wherein the rotation gear and the block drive gear are integral.

6. The rotary engine, pump or compressor as recited in claim 2, and further wherein the rotation gear is driven by the driveshaft at a rotation ratio of six-to-five.

7. The rotary engine, pump or compressor as recited in claim 2, and further wherein:

the transfer port at the terminal end of each cylinder is disposed to alternately form a passageway with the intake port and the exhaust port in the port plate.

8. The rotary engine, pump or compressor as recited in claim 1, and further comprising an ignition device mounted to each of the first port plate and the second port plate such that rotation of the transfer port about the central axis causes the transfer port to form a passageway with the sparking device.

9. The rotary engine, pump or compressor as recited in claim 8, and further wherein the ignition device is a spark plug.

10. The rotary engine, pump or compressor as recited in claim 1, and further comprising:

a circular base aperture between the first and second piston rods; and wherein the first crankset and the second crankset each comprise:

the crankpin eccentrically mounted to a circular base mounted within the circular base aperture, the circular base disposed to rotate about a crankpin axis, the crankpin rotating about both the crankpin axis and the crankset.

11. The rotary engine, pump or compressor as recited in claim 10, and further wherein the circular base aperture is integral with the first and second piston sets.

12. The rotary engine, pump or compressor as recited in claim 1, and further wherein the crankpin gear is in fixed relation to the crankpin by mounting the crank pin gear to the crankpin.

13. The rotary engine, pump or compressor as recited in claim 1, and further wherein the crankpin gear is in fixed relation to the crankpin by mounting the crank pin gear around the crankpin.

14. The rotary engine, pump or compressor as recited in claim 1, and further wherein the inward side of the crankpin is eccentrically and rotatably mounted in an inner crank module which is operatively attached to the inner crank gear, such that the rotation of the crankpin rotates the inner crank module and the inner crank gear about the crankset axis.

15. A rotary engine, pump or compressor, comprising:

a stationary framework comprising a first port plate at a first side of the framework and a second port plate at a second side of the framework and fixed relative to the first port plate, each port plate comprising an intake port and an exhaust port through the port plate;

a block rotatably mounted relative to the stationary framework and about a central axis;

a first cylinder set and a second cylinder set mounted in the block in opposing relation from one another about the central axis, each cylinder set comprising:

a first cylinder and an opposing second cylinder, each cylinder comprising a proximal end and a terminal end having a transfer port disposed to alternately form a passageway with the intake port and the exhaust port in the port plate;

a first piston set movably mounted within the first cylinder set and a second piston set movably mounted within the second cylinder set, the first and second piston sets each comprising:

a first piston in the first cylinder and a second piston in the second cylinder, each piston comprising a piston head with a piston face and a piston rod having a first end mounted to the piston head, wherein the piston rods are operatively attached to one another;

a first crankset driven by the first piston set and a second crankset driven by the second piston set, the first crankset and the second crankset each comprising:

a crankpin eccentrically mounted to the piston set to rotate about a crankpin axis;

a crankpin gear fixed to the crankpin;

an internal gear fixed relative to the first cylinder set, the internal gear having an internal gear configured to mate with the crankpin gear as the crankpin gear rotates within the internal gear;

wherein the eccentric rotation of the crankpin offsets the rotation of the crankpin gear within the internal gear to provide approximately linear movement of the piston heads within the first and second cylinders and such that the crankpin also rotates about a crankset axis;

an outward side of the crankpin being eccentrically mounted to an outer crank gear, such that the rotation of the crankpin also rotates the outer crank gear about the crankset axis;

an inward side of the crankpin being eccentrically mounted to an inner crank gear, such that the rotation of the crankpin also rotates the inner crank gear about the crankset axis;

wherein the generally linear movement of the circular base aperture of the piston set drives the crankpin gear to rotate around within the internal gear, thereby driving the crankpin to rotate about the crankpin axis;

the inner crank gear mating with a driveshaft gear such that the rotation of the inner crank gear rotates the driveshaft;

the outer crank gear mating with a stationary ring gear around the first and second cylinder sets such that the rotation of the outer crank gear against the ring gear drives the rotation of the first cylinder set and the second cylinder set around the central axis.

16. The rotary engine, pump or compressor as recited in claim 15, and further comprising an ignition device mounted to each of the first port plate and the second port plate such that rotation of the transfer port about the central axis causes the transfer port to form a passageway with the sparking device.

17. The rotary engine, pump or compressor as recited in claim 16, and further wherein the ignition device is a spark plug.

18. The rotary engine, pump or compressor as recited in claim 16, and further wherein:

the transfer port at the terminal end of each cylinder is disposed to alternately form a passageway with the intake port and the exhaust port in the port plate.

19. The rotary engine, pump or compressor as recited in claim 15, and further comprising:

a circular base aperture between the first and second piston rods; and wherein the first crankset and the second crankset each comprise:

the crankpin eccentrically mounted to a circular base mounted within the circular base aperture, the circular base disposed to rotate about a crankpin axis, the crankpin rotating about both the crankpin axis and the crankset.

20. The rotary engine, pump or compressor as recited in claim 19, and further wherein the circular base aperture is integral with the first and second piston sets.

21. The rotary engine, pump or compressor as recited in claim 15, and further wherein the crankpin gear is in fixed relation to the crankpin by mounting the crank pin gear to the crankpin.

22. The rotary engine, pump or compressor as recited in claim 15, and further wherein the crankpin gear is in fixed relation to the crankpin by mounting the crank pin gear around the crankpin.

23. The rotary engine, pump or compressor as recited in claim 15, and further wherein the outward side of the crankpin is eccentrically and rotatably mounted in an outer crank module which is operatively attached to the outer crank gear, such that the rotation of the crankpin rotates the outer crank module and the outer crank gear about the crankset axis.

24. The rotary engine, pump or compressor as recited in claim 15, and further wherein the inward side of the crankpin is eccentrically and rotatably mounted in an inner crank module which is operatively attached to the inner crank gear, such that the rotation of the crankpin rotates the inner crank module and the inner crank gear about the crankset axis.

25. A rotary engine, pump or compressor, comprising:

a framework comprising a first port plate at a first side of the framework and a second port plate at a second side of the framework and fixed relative to the first port plate, each port plate rotatably mounted relative to the framework and each comprising an intake port and an exhaust port through the port plate;

a block mounted relative to the framework and about a central axis;

a first cylinder set and a second cylinder set mounted in the block in opposing relation from one another about the central axis, each cylinder set comprising:

a first cylinder and an opposing second cylinder, each cylinder comprising a proximal end and a terminal end having a transfer port disposed to alternately form a passageway with the intake port and the exhaust port in the port plate;

a first piston set movably mounted within the first cylinder set and a second piston set movably mounted within the second cylinder set, the first and second piston sets each comprising:

a first piston in the first cylinder and a second piston in the second cylinder, each piston comprising a piston head with a piston face and a piston rod having a first end mounted to the piston head, wherein the piston rods are operatively attached to one another;

a first crankset driven by the first piston set and a second crankset driven by the second piston set, the first crankset and the second crankset each comprising:

a crankpin eccentrically mounted to the piston set to rotate about a crankpin axis;

a crankpin gear fixed to the crankpin;

an internal gear fixed relative to the first cylinder set, the internal gear having an internal gear configured to mate with the crankpin gear as the crankpin gear rotates within the internal gear;

wherein the eccentric rotation of the crankpin offsets the rotation of the crankpin gear within the internal gear to provide approximately linear movement of the piston heads within the first and second cylinders and such that the crankpin also rotates about a crankset axis;

an inward side of the crankpin being eccentrically mounted to an inner crank gear, such that the rotation of the crankpin also rotates the inner crank gear about the crankset axis;

wherein the generally linear movement of the circular base aperture of the piston set drives the crankpin gear to rotate around within the internal gear, thereby driving the crankpin to rotate about the crankpin axis; and the inner crank gear mating with a driveshaft gear such that the rotation of the inner crank gear rotates the driveshaft.

26. The rotary engine, pump or compressor as recited in claim 25, and which further comprises a rotation gear rotatably mounted relative to the framework and operatively attached to and driven by the driveshaft, and further wherein the rotation gear is disposed to drive the rotation of the first port plate and the second port plate.

27. The rotary engine, pump or compressor as recited in claim 25, and further comprising:

a circular base aperture between the first and second piston rods; and wherein the first crankset and the second crankset each comprise:

the crankpin eccentrically mounted to a circular base mounted within the circular base aperture, the circular base disposed to rotate about a crankpin axis, the crankpin rotating about both the crankpin axis and the crankset.

28. The rotary engine, pump or compressor as recited in claim 27, and further wherein the circular base aperture is integral with the first and second piston sets.

29. The rotary engine, pump or compressor as recited in claim 25, and further wherein the crankpin gear is in fixed relation to the crankpin by mounting the crank pin gear to the crankpin.

30. The rotary engine, pump or compressor as recited in claim 25, and further wherein the crankpin gear is in fixed relation to the crankpin by mounting the crank pin gear around the crankpin.

31. The rotary engine, pump or compressor as recited in claim 25, and further wherein the inward side of the crankpin is eccentrically and rotatably mounted in an inner crank module which is operatively attached to the inner crank gear, such that the rotation of the crankpin rotates the inner crank module and the inner crank gear about the crankset axis.

* * * * *

UNITED STATES PATENT AND TRADEMARK OFFICE

CERTIFICATE OF CORRECTION

PATENT NO. : 6,672,263 B2
DATED : January 6, 2004
INVENTOR(S) : Vallejos

It is certified that error appears in the above-identified patent and that said Letters Patent is hereby corrected as shown below:

Column 8,
Line 51, insert -- Figure 16 is an exploded view of piston bolt 371 and lock pin 372 in a relative configuration thereof. The piston bolt and lock pin configuration are utilized to create an integral or unitary piston set 362 as shown more fully in Figure 15. The piston bolt may be rotated or screwed into a recipient threaded aperture in the piston rod 366 or piston rod 365 to secure it therein and then lock pin 372 may be inserted into piston bolt 371 to secure the middle portion of piston set 362 to the respective piston heads 363 and 364. --

Signed and Sealed this

Twentieth Day of July, 2004

JON W. DUDAS
*Acting Director of the United States Patent and Trademark Office*